US009169676B2

(12) United States Patent
Watanabe et al.

(10) Patent No.: US 9,169,676 B2
(45) Date of Patent: Oct. 27, 2015

(54) VEHICULAR LATCH DEVICE

(75) Inventors: Hirofumi Watanabe, Kanagawa (JP); Shintaro Okawa, Kanagawa (JP)

(73) Assignee: MITSUI KINZOKU ACT CORPORATION, Yokohama-shi (JP)

( * ) Notice: Subject to any disclaimer, the term of this patent is extended or adjusted under 35 U.S.C. 154(b) by 245 days.

(21) Appl. No.: 13/353,916

(22) Filed: Jan. 19, 2012

(65) Prior Publication Data

US 2012/0193926 A1 Aug. 2, 2012

(30) Foreign Application Priority Data

Jan. 28, 2011 (JP) ..... 2011-017261

(51) Int. Cl.

| | |
|---|---|
| ***E05C 3/06*** | (2006.01) |
| ***E05B 85/02*** | (2014.01) |
| ***E05B 77/34*** | (2014.01) |
| ***E05B 77/38*** | (2014.01) |
| ***E05B 81/14*** | (2014.01) |
| ***E05B 81/36*** | (2014.01) |
| ***E05B 81/66*** | (2014.01) |

(52) U.S. Cl.

CPC ..... *E05B 85/02* (2013.01); *E05B 77/34* (2013.01); *E05B 77/38* (2013.01); *E05B 81/14* (2013.01); *E05B 81/36* (2013.01); *E05B 81/66* (2013.01); *Y10T 292/1075* (2015.04)

(58) Field of Classification Search

CPC ..... E05B 77/34; E05B 77/38; E05B 81/14; E05B 81/36; E05B 81/66; E05B 85/02; Y10T 292/1075

USPC ..... 292/195, 201, 216, DIG. 23, DIG. 42, 292/DIG. 43

See application file for complete search history.

(56) References Cited

U.S. PATENT DOCUMENTS

| | | | | |
|---|---|---|---|---|
| 5,737,876 | A * | 4/1998 | Dowling | 49/360 |
| 7,005,616 | B2 * | 2/2006 | Kim et al. | 219/451.1 |
| 2001/0050484 | A1 * | 12/2001 | Kobayashi et al. | 292/216 |
| 2002/0175061 | A1 * | 11/2002 | Shinkawa | 200/252 |
| 2003/0038485 | A1 * | 2/2003 | Schwaiger et al. | 292/201 |
| 2005/0218662 | A1 * | 10/2005 | Umino | 292/216 |
| 2008/0256755 | A1 | 10/2008 | Ieda et al. | |
| 2009/0085514 | A1 * | 4/2009 | Mizoguchi et al. | 320/113 |

FOREIGN PATENT DOCUMENTS

| | | | |
|---|---|---|---|
| GB | 2 359 852 | A | 9/2001 |
| GB | 2 424 036 | A | 9/2006 |
| JP | 11-62347 | A | 3/1999 |
| JP | 2002-332767 | A | 11/2002 |

(Continued)

*Primary Examiner* — Kristina Fulton
*Assistant Examiner* — Christine M Mills
(74) *Attorney, Agent, or Firm* — Foley & Lardner LLP

(57) ABSTRACT

A latch device for vehicle LA provided on a door D of a vehicle, including: a latch 20, which meshes with a striker S; a ratchet 30, which regulates rotation of the latch 20; a detecting sensor 200 including a body 201 and terminals 202*a* and 202*b* exposed from the body 201, which detects operation of the latch 20 or the ratchet 30; and a main body 40 in which the detecting sensor 200 is arranged, wherein the main body 40 includes a discharging portion 417 formed on a position corresponding to the terminals 202*a* and 202*b* of the latch detecting sensor 200, and the terminals 202*a* and 202*b* of the detecting sensor 200 are arranged on an upper side of a vehicle than the discharging portion 417 in a state in which the door D is closed.

9 Claims, 17 Drawing Sheets

(56) References Cited

FOREIGN PATENT DOCUMENTS

| | | | |
|---|---|---|---|
| JP | 2004-169426 | A | 6/2004 |
| JP | 2006-328702 | A | 12/2006 |
| WO | WO 2006/001263 | A1 | 1/2006 |

* cited by examiner

UNLOCKED STATE

LOCKED STATE

VEHICULAR LATCH DEVICE

FIELD

The present invention relates to a vehicular latch device applied to a door of a vehicle.

BACKGROUND

The vehicular latch device for maintaining a closed state of a door of a vehicle body is provided between the vehicle body and the door on the vehicle such as a four-wheeled vehicle. The vehicular latch device is composed by arranging a latch and a ratchet on a cover plate including a striker entry groove. The vehicular latch device is configured to regulate rotation in an opening direction by allowing the latch to mesh with a striker, which enters the striker entry groove, and allowing the ratchet to engage with the latch, thereby preventing the striker from deviating from the striker entry groove to maintain the state in which the door is closed. On the other hand, when an engaging state of the ratchet with the latch is released, a meshing state of the latch with the striker also is released and it becomes possible that the striker is deviated from the striker entry groove. According to this, it becomes possible to open the door of the vehicle body.

As the vehicular latch device of this type, one provided with a detecting sensor for detecting a rotational position of the latch is provided. The detecting sensor is provided with a plunger, which pushes by the rotation of the latch, and may output a detection signal corresponding to the rotational position of the latch by push of the plunger. The vehicular latch device provided with the detecting sensor may detect the meshing state of the latch with the striker based on the detection signal of the detecting sensor (for example, refer to Patent Document 1).

CITATION LIST

Patent Literatures

Patent Document 1: Japanese Patent Application Laid-Open No. H11-62347

SUMMARY

Technical Problem

In the above-described vehicular latch device, it is designed to prevent water such as rainwater from entering the latch detecting sensor by fitting a case onto the detecting sensor. By covering the detecting sensor with the case, it is possible to prevent the latch detecting sensor from causing trouble in operation by the water, which enters the vehicular latch device. However, as the number of components increases by providing the case, a cost increases.

In consideration of the above-described circumstances, an object of the present invention is to provide the vehicular latch device capable of preventing the operation trouble of the detecting sensor by the water such as the rainwater at a low cost.

Solution to Problem

According to an aspect of the present invention, a latch device for vehicle provided on a door of a vehicle includes: a latch which meshes with a striker; a ratchet which regulates rotation of the latch; a detecting sensor including a body and a terminal exposed from the body, which detects operation of the latch or the ratchet; and a main body in which the detecting sensor is arranged. The main body includes a discharging portion at a position corresponding to the terminal of the detecting sensor, and the terminal of the detecting sensor is arranged on an upper side of the vehicle than the discharging portion in a state in which the door is closed.

According to another aspect of the present invention, a latch device for vehicle provided on a door of a vehicle includes: a latch which meshes with a striker; a ratchet which regulates rotation of the latch; a detecting sensor including a body and a terminal exposed from the body, which detects operation of the latch or the ratchet; and a main body in which the detecting sensor is arranged. A discharging portion to discharge water is included on a position corresponding to the terminal of the detecting sensor, and the terminal of the detecting sensor is arranged on an upstream side of the discharging portion with respect to a flow of the water.

Advantageously, in the latch device for vehicle, the discharging portion is formed so as to extend from the body of the detecting sensor toward a side of the terminal.

Advantageously, in the latch device for vehicle, the detecting sensor includes at least two terminals, and the main body includes a rib for separating the two terminals arranged on the discharging portion.

Advantageously, in the latch device for vehicle, the detecting sensor is arranged so as to abut the rib.

Advantageously, in the latch device for vehicle, the main body includes a surface on which the detecting sensor is arranged, and the latch and the ratchet are arranged on a side opposite to the detecting sensor through the surface of the main body.

Advantageously, in the latch device for vehicle, the main body includes a surface on which the detecting sensor is arranged, and the detecting sensor, the latch, and the ratchet are arranged on the same surface of the main body.

Advantageous Effects of Invention

The vehicular latch device according to the present invention may prevent a detecting sensor 200 from causing trouble in operation without providing the case on the detecting sensor by discharging the water outside from the discharging portion formed on the main body to avoid accumulation of the water even when the water such as the rainwater enters the vehicular latch device.

DESCRIPTION OF EMBODIMENTS

Preferred embodiments of a vehicular latch device according to the present invention are hereinafter described in detail with reference to the attached drawings.

First Embodiment

Figure 1:
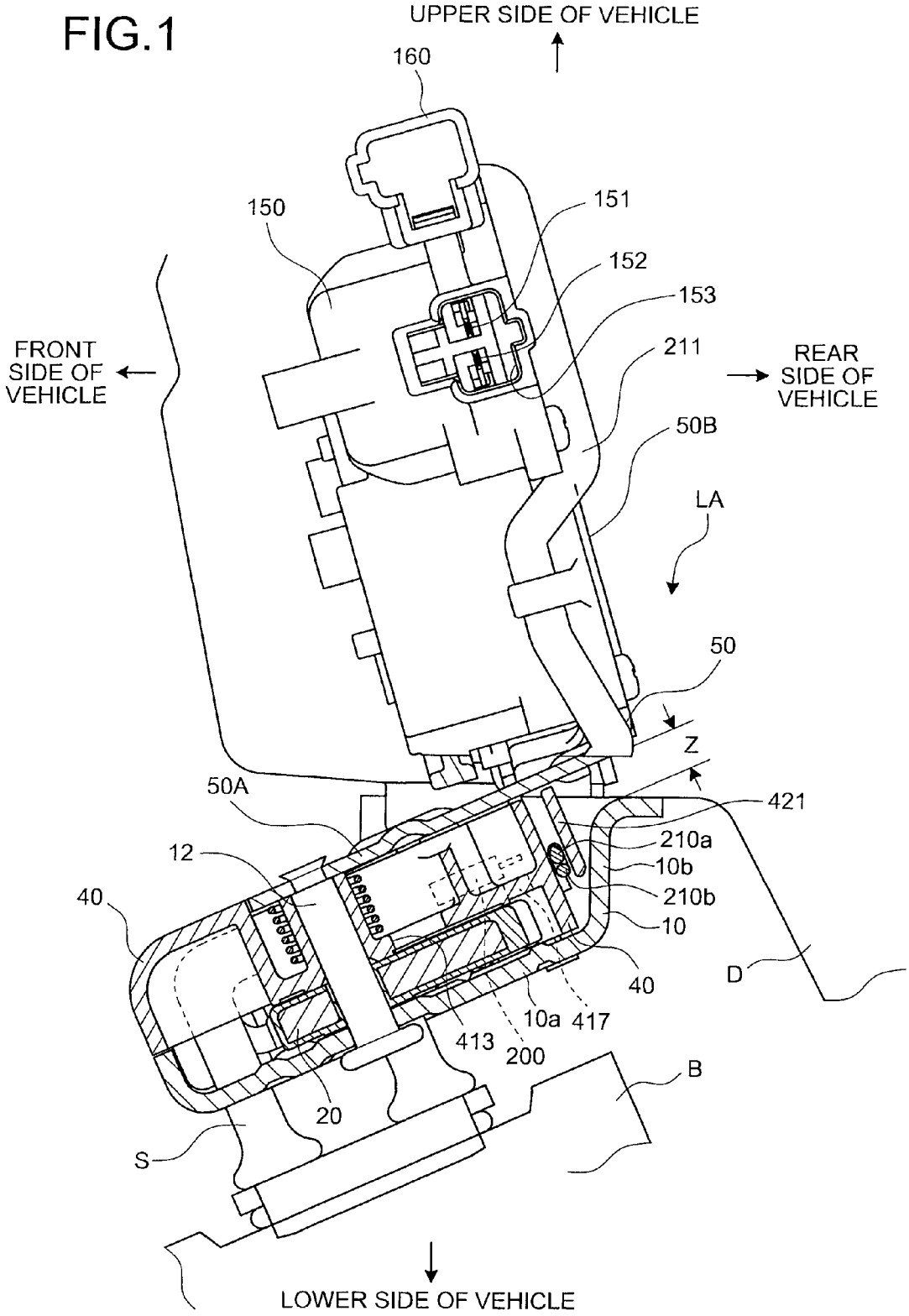
FIG. 1 is a partially broken side view illustrating a substantial part of a vehicular latch device being an embodiment of the present invention.
Figure 2:
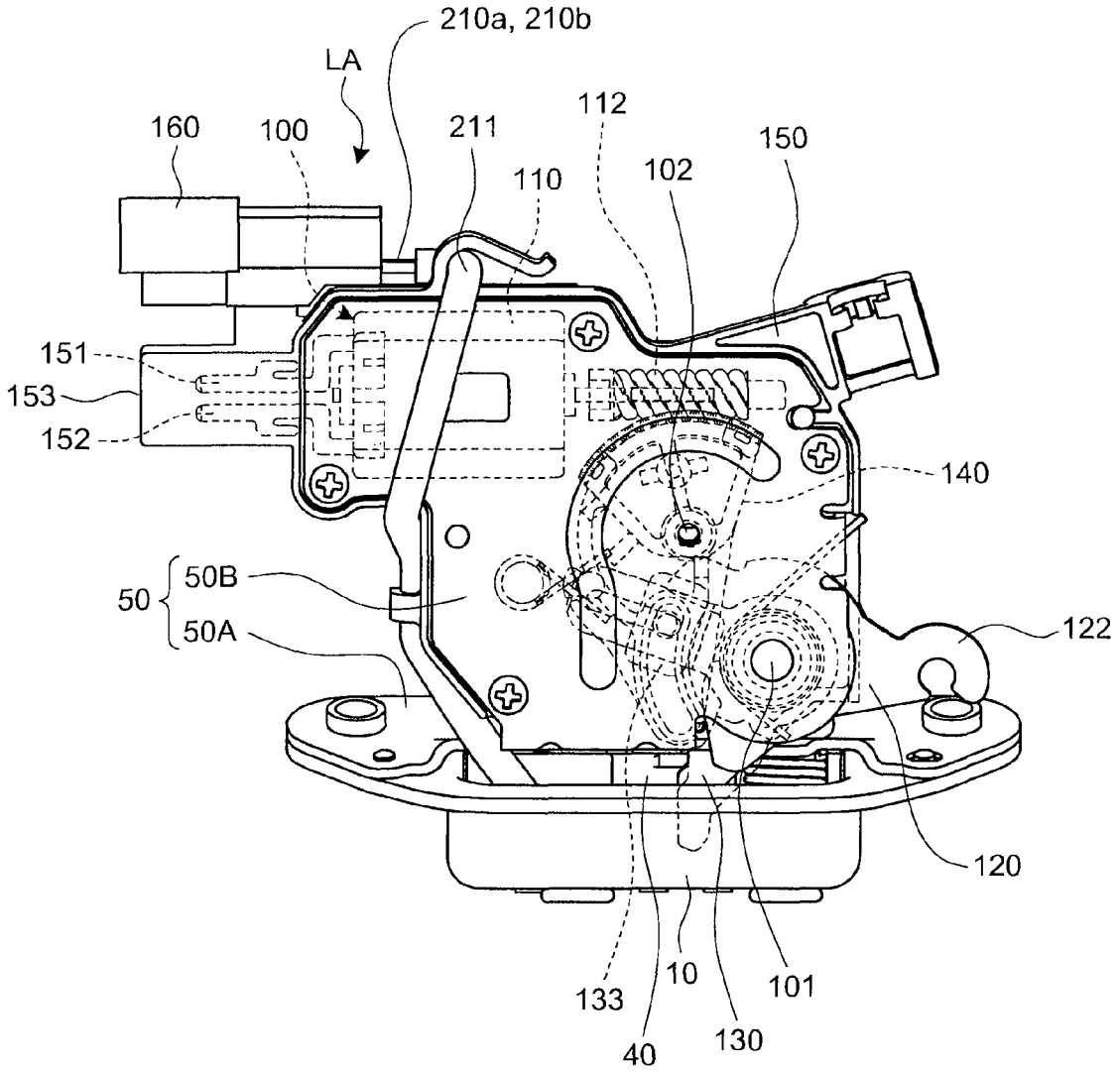
FIG. 2 is a rear view of the vehicular latch device illustrated in FIG. 1.
Figure 3:
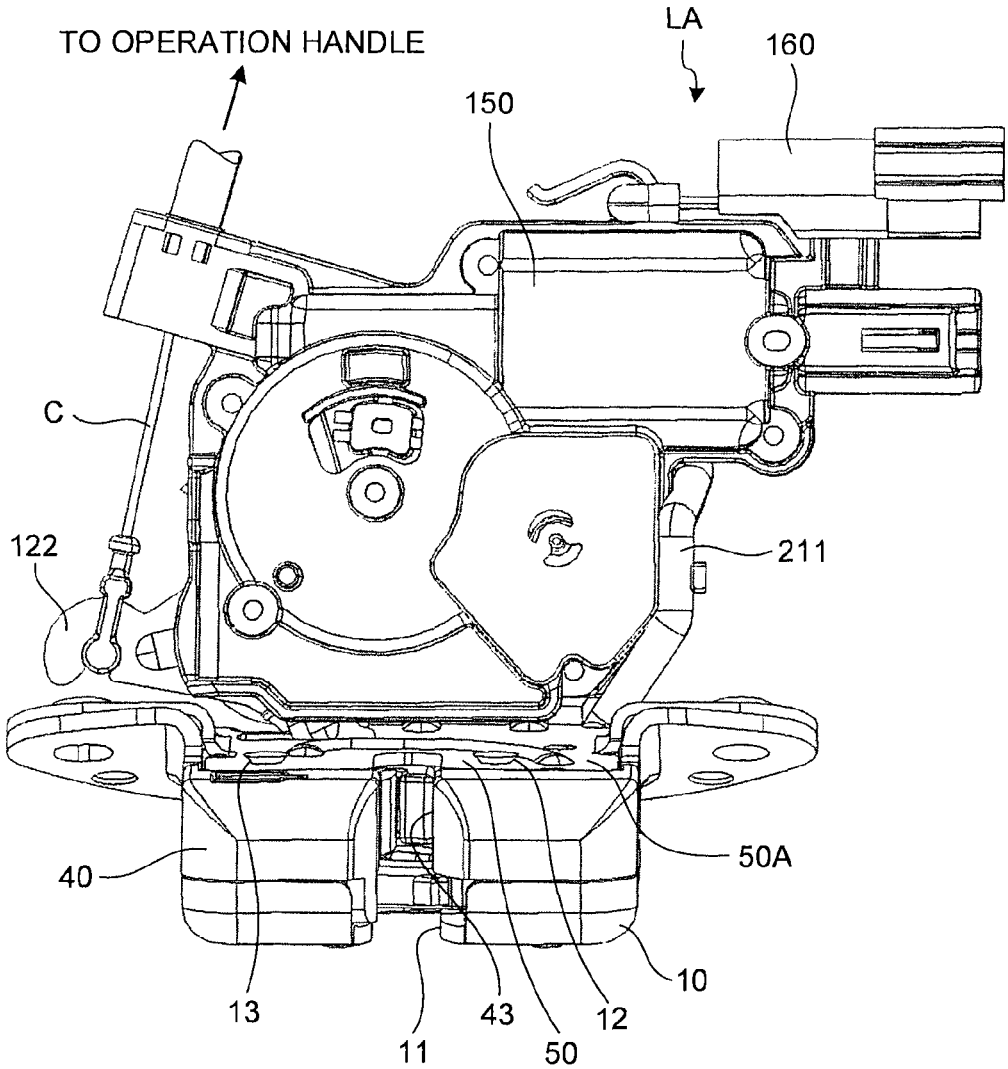
FIG. 3 is a front view of the vehicular latch device illustrated in FIG. 1.
Figure 4:
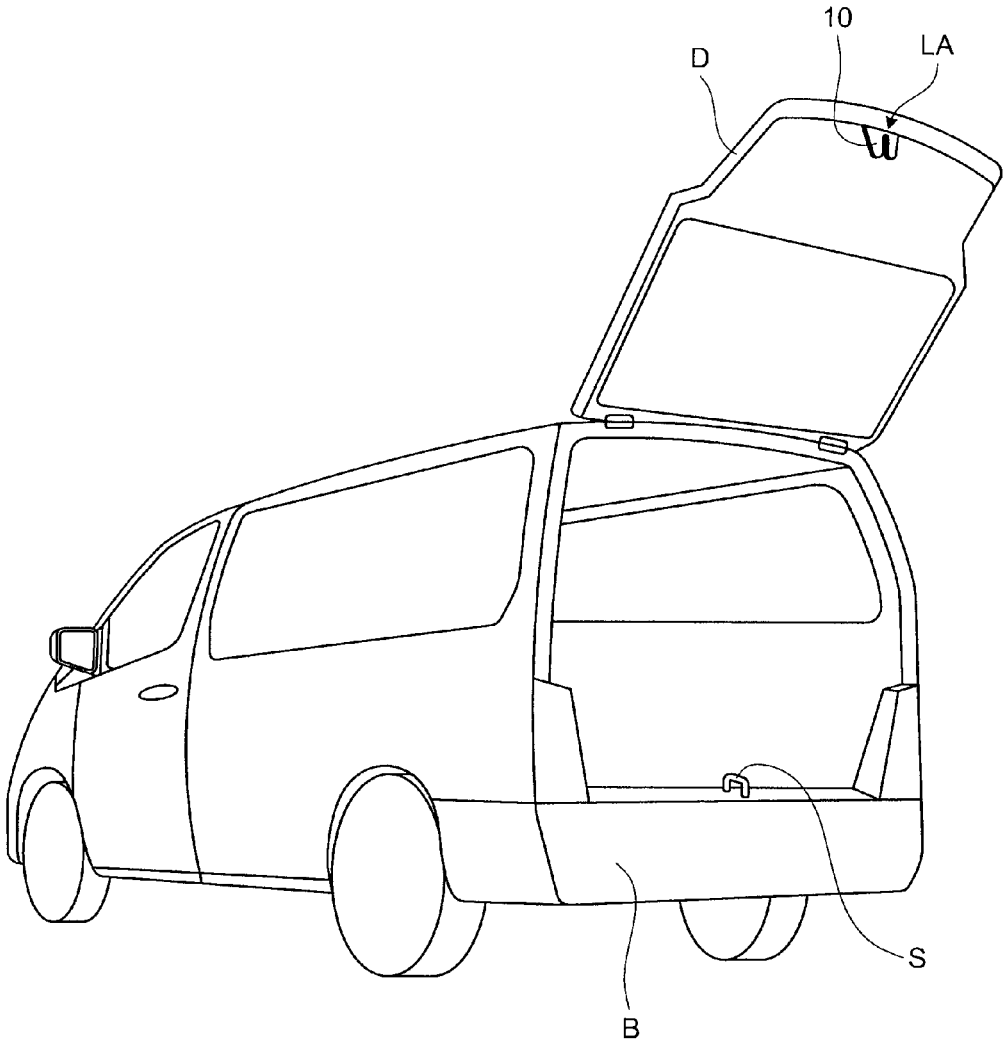
FIG. 4 is a perspective view of a four-wheeled vehicle to which the vehicular latch device illustrated in FIG. 1 is applied.

FIGS. 1 to 3 illustrate a vehicular latch device LA being a first embodiment of the present invention. The vehicular latch device LA herein illustrated is configured to mesh with a striker S provided on a vehicle body B of a four-wheeled vehicle, thereby maintaining a closed state of a back door D referred to as a tailgate of the vehicle body B as illustrated in FIG. 4. The back door D is supported on a rear end upper edge of the vehicle body B, and it is possible to open and close an opening on a rear end of the vehicle body B by rotating the same about an axis in a lateral direction of a rear face of the vehicle body B.

The vehicular latch device LA of this embodiment is provided with a cover plate 10, a main body 40, and a back plate 50 as illustrated in FIGS. 1 to 3 and 6.

The cover plate 10, which is a base of the vehicular latch device LA, is formed of a relatively thick, large metal plate. As illustrated in FIGS. 1 and 5, the cover plate 10 has a rectangular plate base portion 10*a* and a plate wall portion 10*b* integrally formed with the plate base portion 10*a* to be bent so as to perpendicularly incline from an inner portion of the plate base portion 10*a*. As illustrated in FIGS. 1, 3, 5, and 6, a striker entry groove 11 is provided on the plate base portion 10*a* and a latch shaft 12 and a ratchet shaft 13 are provided on both sides of the striker entry groove 11. The striker entry groove 11, which is a notch formed from a front end central portion toward the inner portion of the plate base portion 10*a*, is formed with a width such that the striker S may be inserted therethrough. The latch shaft 12 and the ratchet shaft 13 are column-shaped members projecting on an inner surface of the plate base portion 10*a* and are arranged so as to be parallel to each other. A latch 20 is rotatably arranged on the latch shaft 12 and a ratchet 30 is rotatably arranged on the ratchet shaft 13.

Figure 7:
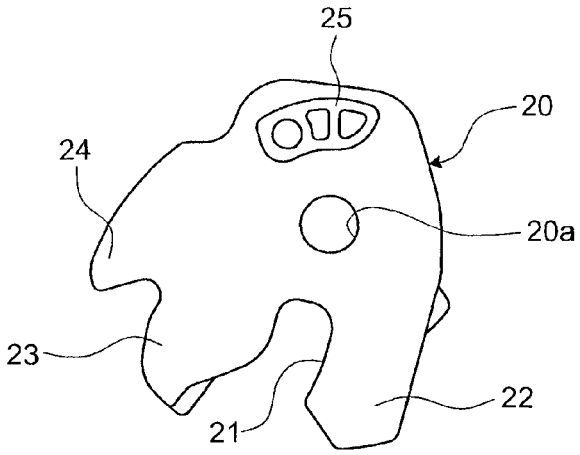
FIG. 7 is a plan view of the latch.

As illustrated in FIG. 7, the latch 20 is a plate-shaped member on which an insertion hole 20*a* through which the latch shaft 12 is inserted is formed and has a meshing groove 21 opening on an outer peripheral surface thereof, a hook portion 22 located on a right side of the meshing groove 21, a striker abutment portion 23 located on a left side of the meshing groove 21, and an outer peripheral detent portion 24 located on a left side of the striker abutment portion 23. The latch 20 has a convex stripe 25 extending in a circumferential direction about the insertion hole 20*a* formed on an upper surface on a side opposite to the cover plate 10 across the insertion hole 20*a*. The latch 20 rotates about an axis of the latch shaft 12 such that the meshing groove 21 intersects with the striker entry groove 11. The latch 20 is biased in a counterclockwise direction in FIG. 5 about the latch shaft 12 by a latch spring 26 arranged between the main body 40 and the convex stripe 25 illustrated in FIG. 8.

Figure 5A:
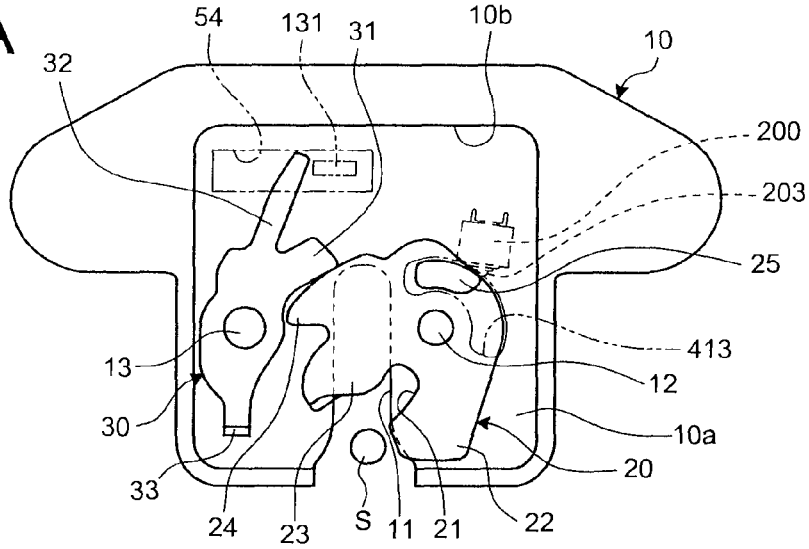
FIGS. 5A to 5C are a schematic plan view illustrating a meshing state of a striker provided on a vehicle body with a latch and a ratchet of the vehicular latch device illustrated in FIG. 1.
Figure 5B:
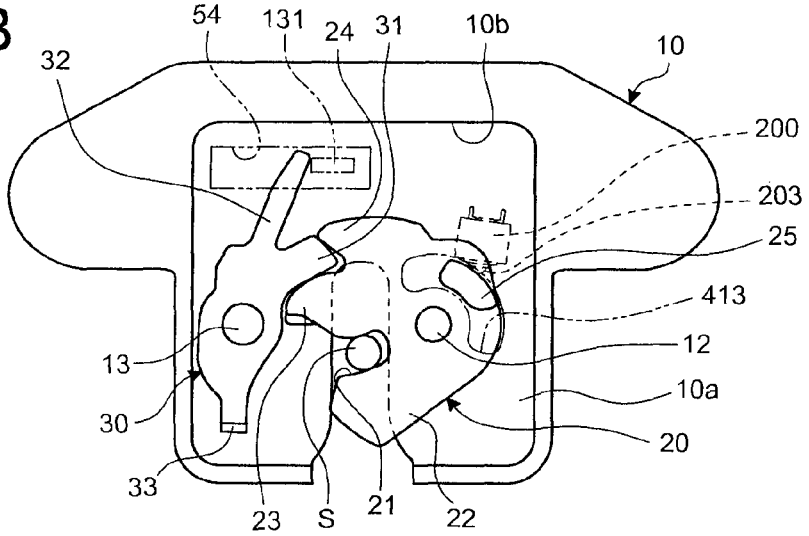
Figure 5C:
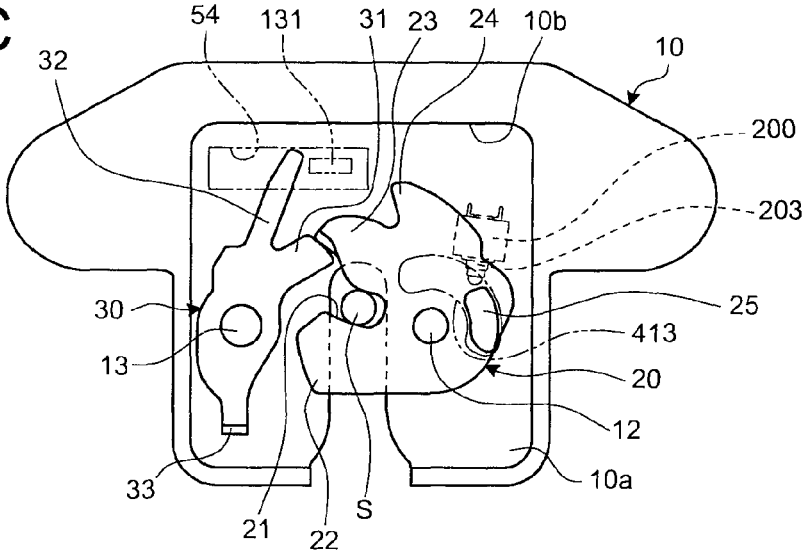

As illustrated in FIG. 5A, when the latch 20 is rotated in the counterclockwise direction (hereinafter, referred to as an "opening direction") about the latch shaft, the hook portion 22 is put into a state retracted from the striker entry groove 11 (hereinafter, a position illustrated in FIG. 5A is referred to as an "unlatched position"). On the other hand, when the latch 20 is rotated in a clockwise direction about the latch shaft (hereinafter, referred to as a "meshing direction"), as illustrated in FIG. 5B, the hook portion 22 gradually moves from a front end side toward an inner portion side of the striker entry groove 11 to come across the same (hereinafter, a position illustrated in FIG. 5B is referred to as a "half-latched position"). When the latch 20 further rotates in the clockwise direction from the half-latched position, the hook portion 22 comes across the inner portion of the striker entry groove 11, thereby blocking an opening of the striker entry groove 11 (hereinafter, a position illustrated in FIG. 5C is referred to as a "fully-latched position").

Figure 8:
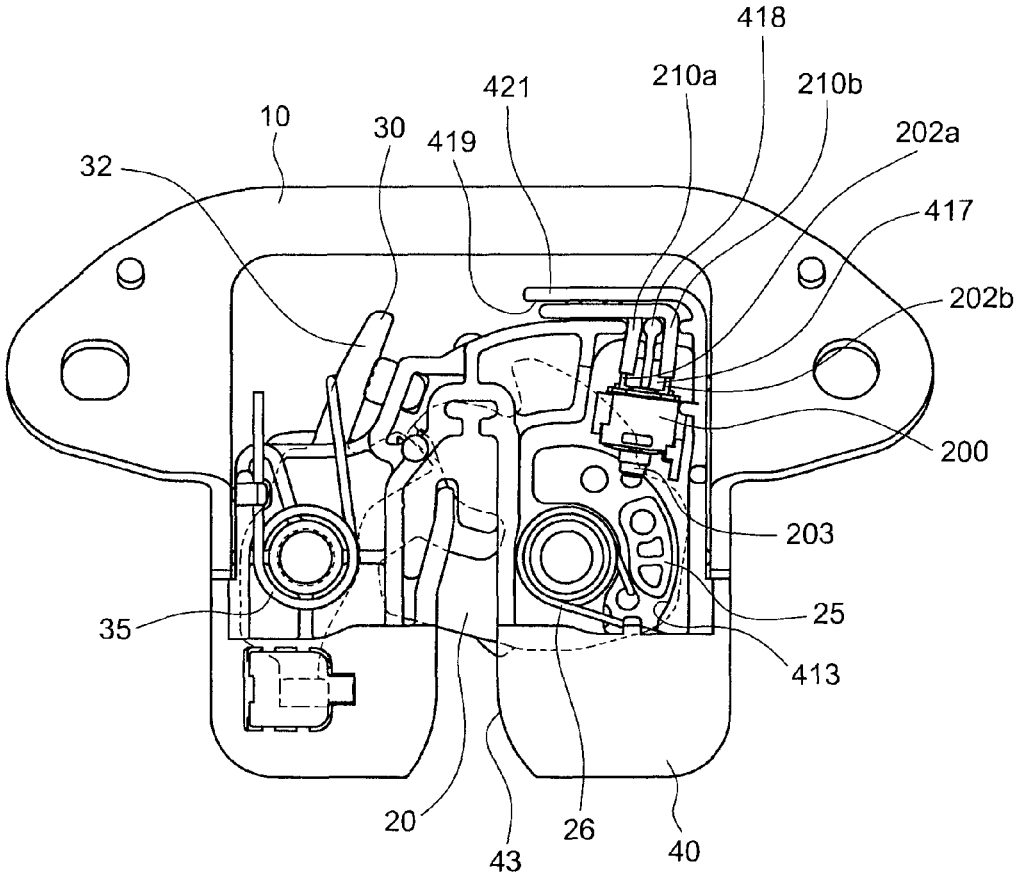
FIG. 8 is a plan view illustrating a state in which the main body and a latch detecting sensor are attached to the cover plate illustrated in FIG. 5.
Figure 9:
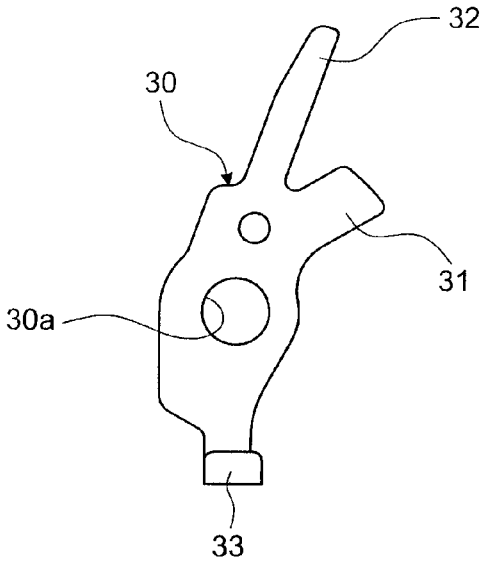
FIG. 9 is a plan view of the ratchet.

The ratchet 30 is a plate-shaped member on which an insertion hole 30*a* through which the ratchet shaft 13 is inserted is formed and has a latch meshing portion 31, a first release operating portion 32, and a second release operating portion 33 as illustrated in FIG. 9. The ratchet 30 rotates about an axis of the ratchet shaft 13 and is biased in the clockwise direction in FIG. 5 about the ratchet shaft 13 by a ratchet spring 35 arranged between the main body 40 and the first release operating portion 32 illustrated in FIG. 8.

The latch meshing portion 31 is a portion radially outwardly extending from the insertion hole 30*a*. The latch meshing portion 31 locks into the striker abutment portion 23 of the latch 20 rotated to the half-latched position when the ratchet 30 is rotated in the counterclockwise direction about the ratchet shaft 13 as illustrated in FIG. 5B. Further, this meshes with the outer peripheral detent portion 24 of the latch 20 rotated to the fully-latched position when the ratchet 30 is rotated in the counterclockwise direction about the ratchet shaft 13 as illustrated in FIG. 5C.

The first release operating portion 32 is a portion located next to the latch meshing portion 31 so as to radially outwardly extend from an outer periphery of the insertion hole 30*a* as illustrated in FIGS. 5 and 9. The second release operating portion 33 is formed so as to radially outwardly extend from the outer periphery of the insertion hole 30*a* on a position shifted from the first release operating portion 32 by approximately 180 degrees and thereafter be bent at a right angle in an extending direction of the ratchet shaft 13.

Figure 6:
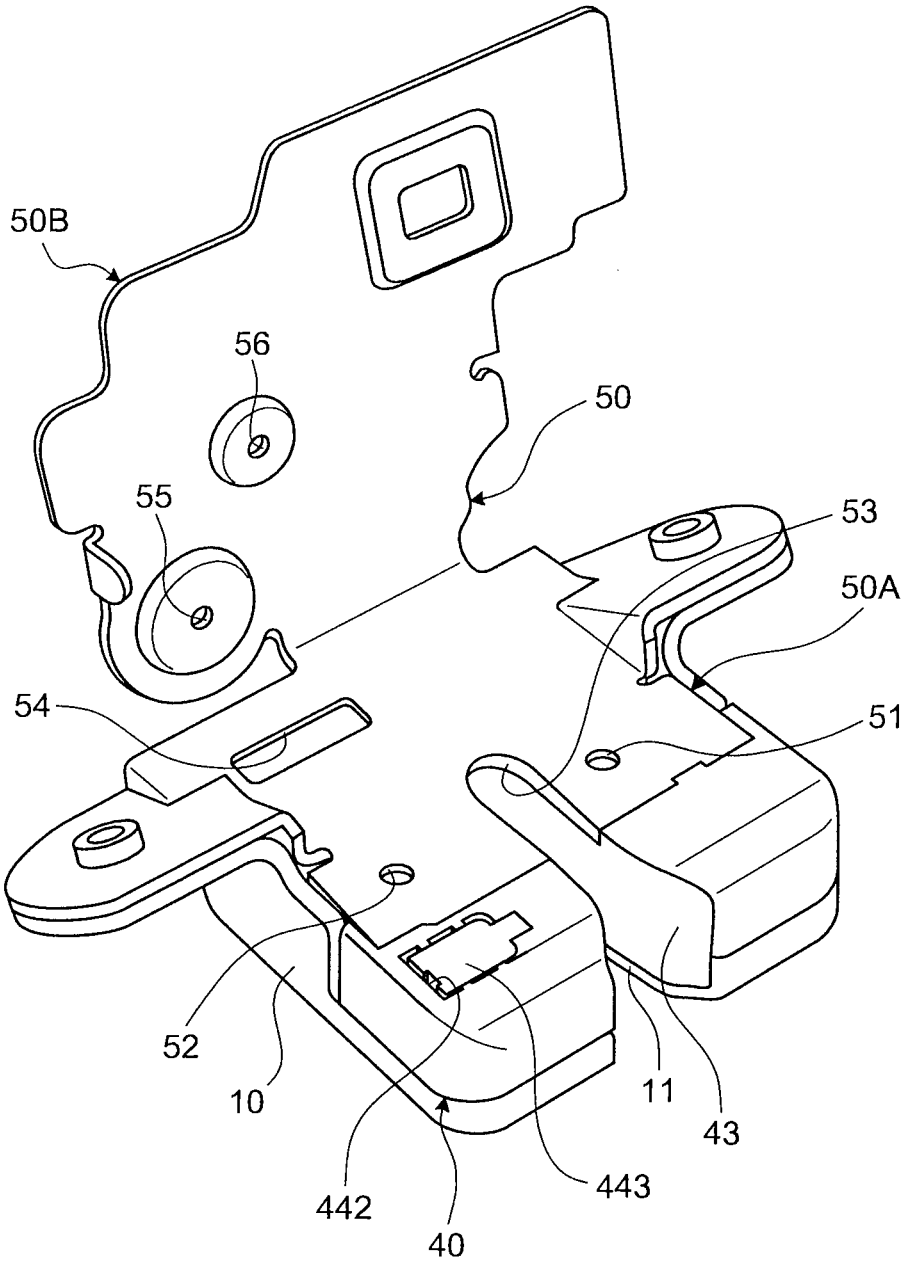
FIG. 6 is a perspective view illustrating a cover plate, a main body, and a back plate applied to the vehicular latch device illustrated in FIG. 1.

The main body 40 is obtained by forming a relatively hard synthetic resin material into a thick block shape and this covers an inner surface of a front end of the cover plate 10 on which the latch 20 and the ratchet 30 are arranged as illustrated in FIG. 6. The main body 40 has a bottom surface portion 410, which is a plate-shaped flat surface, a wall portion 42 perpendicularly provided in a standing manner from the bottom surface portion 410, a buffer groove 43 formed on a position corresponding to the striker entry groove 11, and projected surface portions 44*a* and 44*b* formed on both sides of the buffer groove 43 to cover an inner surface of a front end of the plate base portion 10*a*.

Figure 10:
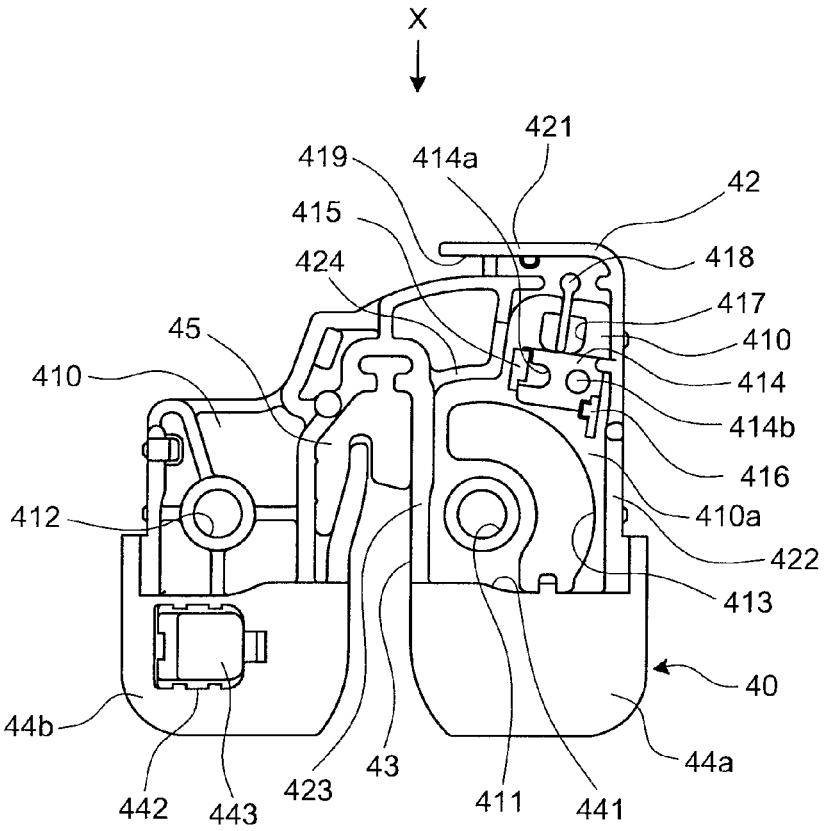
FIG. 10 is a plan view of the main body applied to the vehicular latch device illustrated in FIG. 1 seen from a front side.
Figure 11:
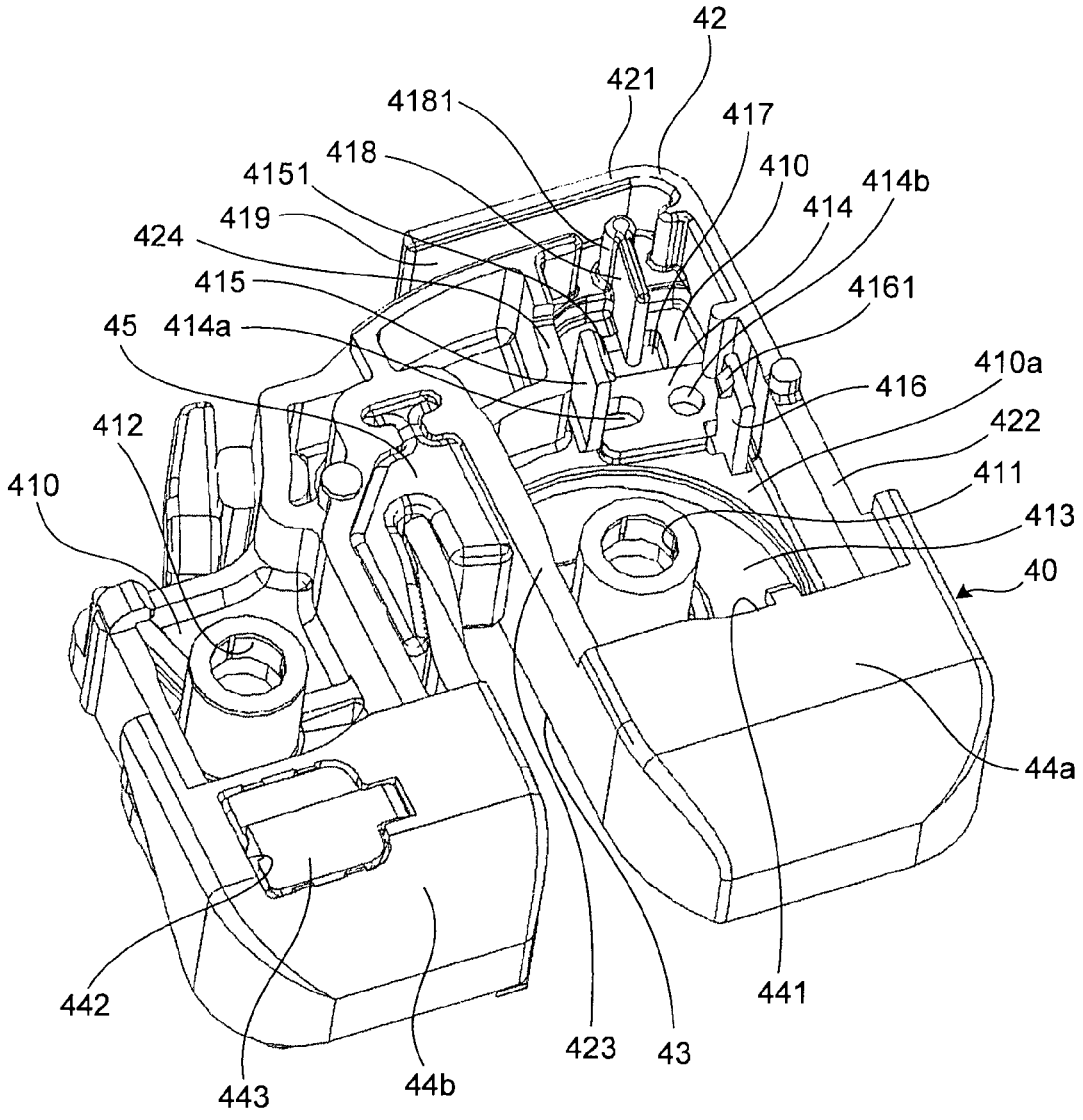
FIG. 11 is a perspective view of the main body illustrated in FIG. 10.
Figure 12:
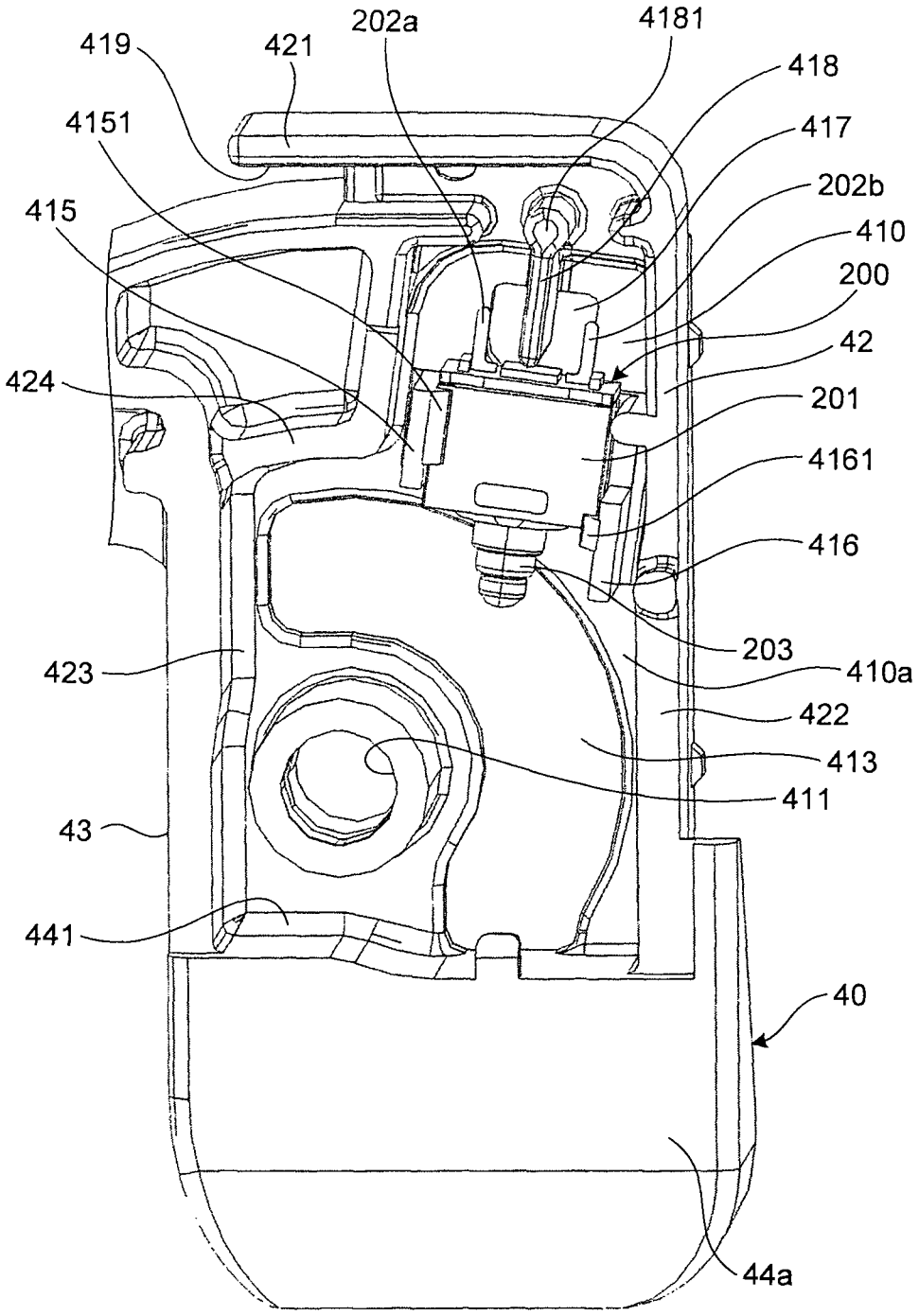
FIG. 12 is a perspective view illustrating a state in which the latch detecting sensor is mounted on the main body illustrated in FIG. 10.

The bottom surface portion 410 has a latch shaft insertion hole 411, a ratchet shaft insertion hole 412, a notch for convex stripe 413, a projected bottom surface 414, sensor locking portions 415 and 416, a discharging hole 417, which forms a discharging portion, and a abutment rib 418 as illustrated in FIGS. 10 to 12. As illustrated in FIG. 10 to 12, a bottom surface portion 410*a* having the latch shaft insertion hole 411, the notch for convex stripe 413, the projected bottom surface 414, the sensor locking portions 415 and 416, the discharging hole 417, and the abutment rib 418 is enclosed by a first wall portion 421 arranged so as to be parallel to the plate wall portion 10*b*, a second wall portion 422 provided so as to perpendicularly extend from the first wall portion 421 to a side of striker entry, a third wall portion 423, which forms a part of the buffer groove 43, a fourth wall portion 424 provided in a coupled manner with the third wall portion 423 from an inner portion of the buffer groove 43 to be bent and extend toward the first wall portion 421, and a side surface 441 on a side of the bottom surface portion 410 of the projected surface portion 44*a*, and a cable insertion groove 419 is formed between the first wall portion 421 and the fourth wall portion 424.

The latch shaft insertion hole 411 and the ratchet shaft insertion hole 412 are formed on positions corresponding to the latch shaft 12 and the ratchet shaft 13, respectively. The latch shaft insertion hole 411 and the ratchet shaft insertion hole 412 are through-holes with inner diameters fit to the latch shaft 12 and the ratchet shaft 13, respectively, and lengths thereof in an axial direction are set to be shorter than that of the latch shaft 12 and the ratchet shaft 13, respectively.

The notch for convex stripe 413 is a through-hole formed on a position corresponding to the convex stripe 25 of the latch 20 and cut in the circumferential direction about the latch shaft insertion hole 411 as illustrated in FIG. 8. The notch for convex stripe 413 through which the convex stripe 25 of the latch 20 penetrates so as to be movable allows rotation of the latch 20 about the latch shaft 12.

The projected bottom surface 414 is formed on the bottom surface portion 410 on a side of the first wall portion 421 in the vicinity of the notch for convex stripe 413 as illustrated in FIGS. 10 to 12. The projected bottom surface 414 is formed into a rectangular shape in a state of being projected from the bottom surface portion 410 and bottom holes 414*a* and 414*b* being through-holes are formed therein. The sensor locking portions 415 and 416 are plate-shaped members perpendicularly provided in a standing manner from the bottom surface portion 410 toward a surface of FIG. 10 with the projected bottom surface 414 interposed therebetween. As illustrated in FIG. 11, locking detents 4151 and 4161 are provided on inner surfaces of tip ends of the sensor locking portions 415 and 416 opposed to each other. A latch detecting sensor 200 to be described later is arranged on the projected bottom surface 414.

The discharging hole 417 is a through-hole obtained by cutting the bottom surface portion 410 as illustrated in FIGS. 10 to 12 and is formed so as to extend from the projected bottom surface 414 toward the first wall portion 421. The discharging hole 417 is formed into a substantially square shape.

The abutment rib 418 is a plate-shaped member perpendicularly provided in a standing manner from the bottom surface portion 410 toward the surface of FIG. 10 as illustrated in FIGS. 10 to 12. As illustrated in FIG. 11, this is formed from a position spaced apart from the first wall portion 421 so as to separate toward the projected bottom surface 414 on the discharging hole 417. An end 4181 on a side of the first wall portion 421 of the abutment rib 418 is formed to be thick.

The buffer groove 43 is a notch provided from a front end central portion toward a base end of the main body 40 as illustrated in FIGS. 10 and 11 and is formed so as to be slightly narrower than the striker entry groove 11. The buffer groove 43 is formed so as to be gradually narrower toward the inner portion thereof while an opening end thereof has a size such that the striker S may be inserted therethrough. Also, an elastic member 45 as a cushion is mounted on an innermost portion of the buffer groove 43.

The projected surface portions 44*a* and 44*b* are surfaces provided on both sides of the buffer groove 43 formed so as to be raised above the bottom surface portion 410 as illustrated in FIGS. 10 and 11. A through-hole 442 for operating the second release operating portion 33 of the ratchet 30 covered with the main body 40 from outside and a lid portion 443 for blocking the through-hole 442 so as to be openable are formed on the projected surface portion 44*b* on a ratchet side.

Figure 13:
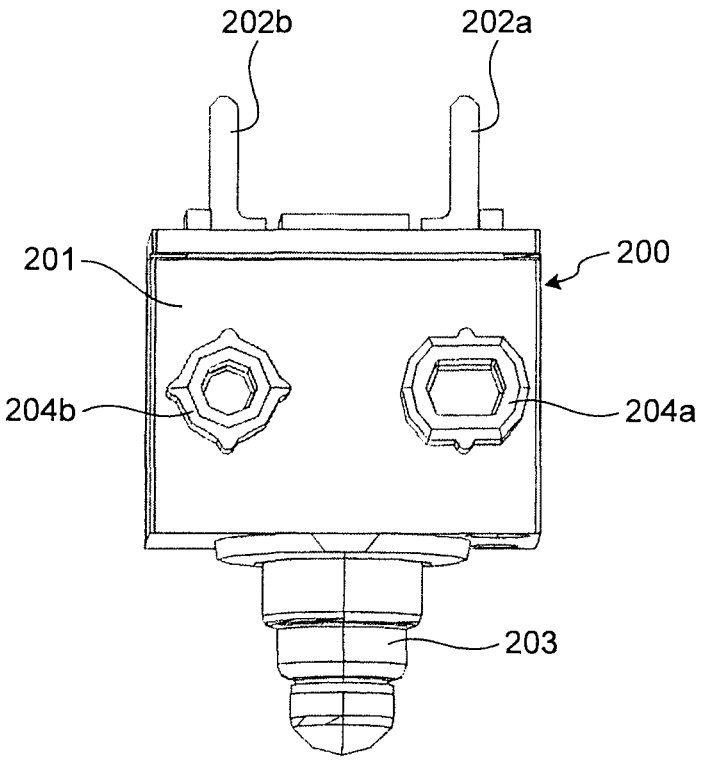
FIG. 13 is a plan view of the latch detecting sensor applied to the vehicular latch device illustrated in FIG. 1 from a rear side.

The latch detecting sensor 200 is arranged on the main body 40. The latch detecting sensor 200, which is referred to as a micro switch, has a sensor body 201 formed into a substantially cuboid shape, a plus terminal 202*a* and a minus terminal 202*b* exposed from the sensor body 201, a plunger 203, and locking projections 204*a* and 204*b* as illustrated in FIG. 13. The sensor body 201 is interposed to be held between the sensor locking portions 415 and 416 on the projected bottom surface 414 of the main body 40. As illustrated in FIGS. 8 and 12, the plus terminal 202*a* and the minus terminal 202*b* are arranged so as to be located above the discharging hole 417. The plunger 203 is arranged so as to be located on a side of the notch for convex stripe 413. The locking projections 204*a* and 204*b* are inserted into the bottom holes 414*a* and 414*b* of the main body 40, respectively, and a side surface on a side of the plus terminal 202*a* and the minus terminal 202*b* of the latch detecting sensor 200 abuts the abutment rib 418 to be fixed to the main body 40. The convex stripe 25 of the latch 20 moves in the notch for convex stripe 413 to abut the plunger 203, and according to this, the plunger 203 detects a rotational position of the latch 20. Signal cables 210*a* and 210*b* for transmitting a detection signal are connected to the plus terminal 202*a* and the minus terminal 202*b* of the latch detecting sensor 200, respectively. The signal cables 210*a* and 210*b* extend from the plus terminal 202*a* and the minus terminal 202*b* to a coupler 160 to be described later.

The back plate 50 is a plate-shaped member having a latch cover portion 50A covering a surface on an inner portion side the main body 40 and a unit holding portion 50B integrally formed with the latch cover portion 50A to be bent from an inner portion of the latch cover portion 50A in a direction away from the main body 40 as illustrated in FIGS. 2 and 6.

The latch cover portion 50A has a latch shaft attaching hole 51 and a ratchet shaft attaching hole 52 formed on positions corresponding to the latch shaft insertion hole 411 and the ratchet shaft insertion hole 412 of the main body 40, respectively, and a notch groove 53 formed on a position corresponding to the striker entry groove 11 of the cover plate 10 as illustrated in FIG. 6. The latch cover portion 50A is attached to the cover plate 10 by crimping a tip end of the latch shaft 12 to the latch shaft attaching hole 51 and by crimping a tip end of the ratchet shaft 13 to the ratchet shaft attaching hole 52, respectively. The latch cover portion 50A has an opening for lever insertion 54 provided on a position corresponding to the first release operating portion 32 of the ratchet 30. The opening for lever insertion 54, which is an opening for operating the first release operating portion 32 from outside, is formed into a rectangular shape in a lateral direction of the latch cover portion 50A and an end of a release operation output portion 131 moves in the lateral direction by rotation of an open lever 130 to be described later.

The unit holding portion 50B is a portion to hold an actuator unit 100 illustrated in FIG. 2. The unit holding portion 50B has supporting holes 55 and 56 for supporting an open lever shaft 101 and a lock lever shaft 102, respectively, formed on a surface facing to the latch cover portion 50A of the back plate 50 as illustrated in FIG. 6.

Figure 14A:
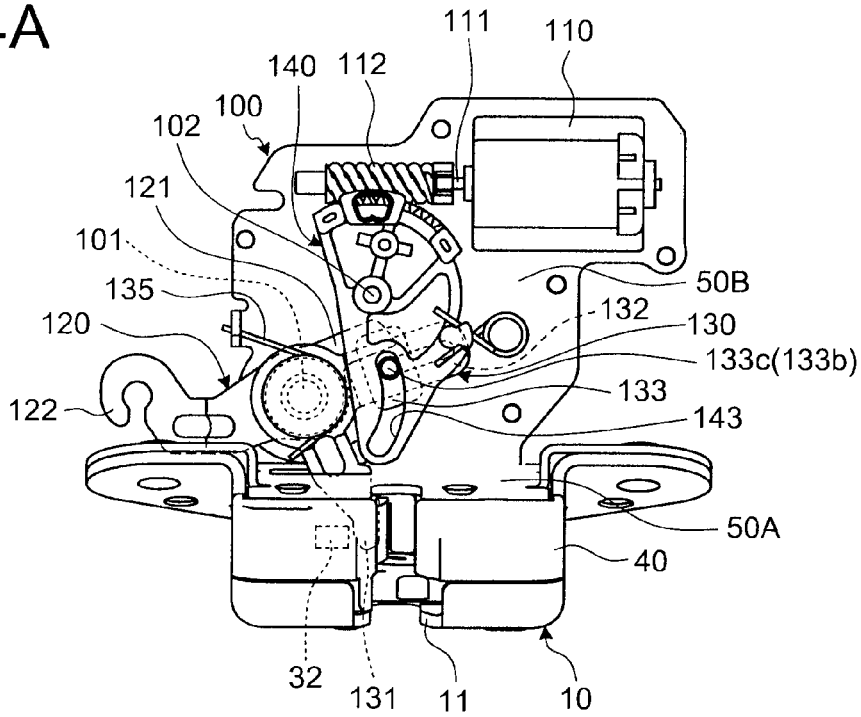
FIGS. 14A and 14B are a front view of operation of an actuator unit when the vehicular latch device illustrated in FIG. 1 is in an unlocked state without a unit cover.

The actuator unit 100 is an electric actuator for switching a locked state and an unlocked state to be described later of the vehicular latch device LA and is provided with a cable lever 120, an open lever 130, a lock lever 140, and an electric motor 110 as illustrated in FIG. 2. The cable lever 120 and the open lever 130 are rotatably supported on the open lever shaft 101 provided on a side edge in the vicinity of the opening for lever insertion 54 (refer to FIG. 6) of the unit holding portion 50B as illustrated in FIGS. 14 and 15.

Figure 15A:
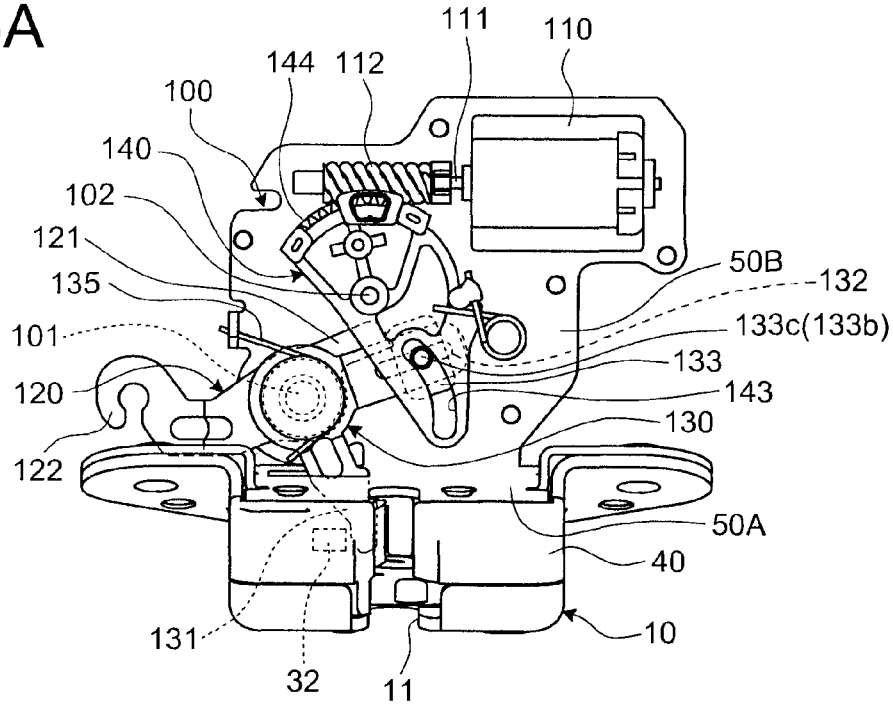
FIGS. 15A and 15B are a front view of the operation of the actuator unit when the vehicular latch device illustrated in FIG. 1 is in a locked state without a unit cover.
Figure 15B:
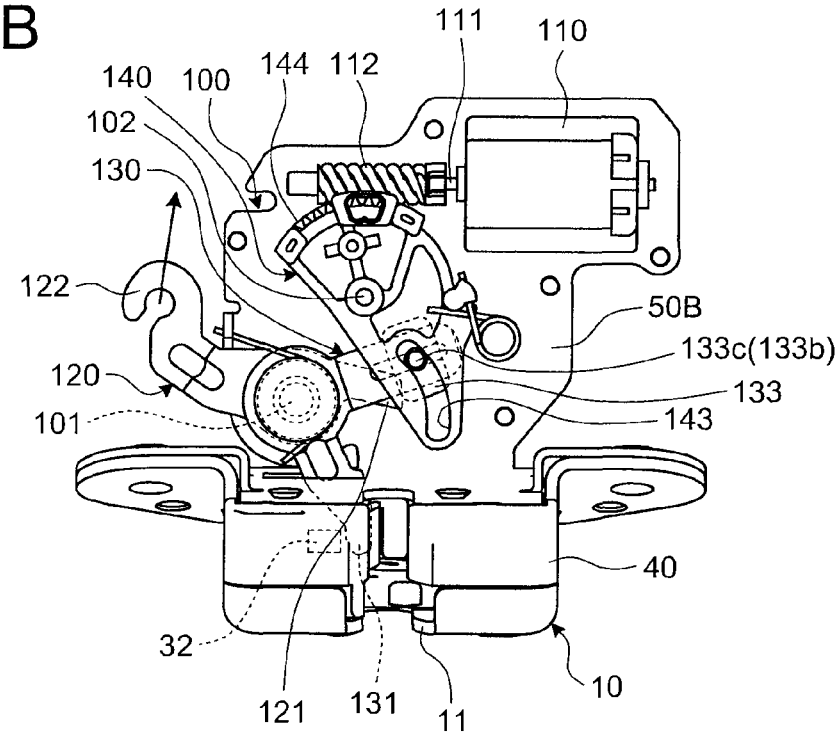
Figure 16:
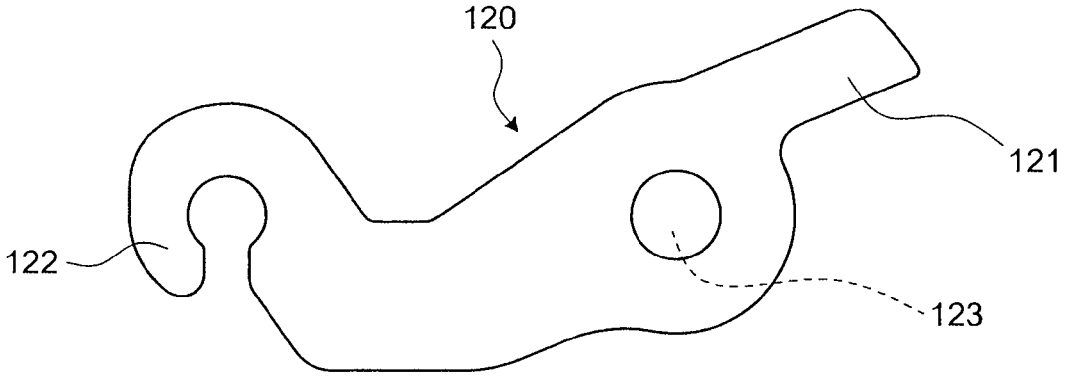
FIG. 16 is a front view of a cable lever applied to the actuator unit of the vehicular latch device illustrated in FIG. 1.

The cable lever 120 is a plate-shaped member arranged between the unit holding portion 50B and the open lever 130 as illustrated in FIGS. 14 and 15 and has an operation output portion 121, a cable engaging portion 122, and a shaft hole 123 through which the open lever shaft 101 is inserted as illustrated in FIG. 16. The operation output portion 121 is radially outwardly provided about the shaft hole 123. The cable engaging portion 122 is radially outwardly provided on a position opposed to the operation output portion 121 across the shaft hole 123 and an end thereof projects outward from one side edge of the unit holding portion 50B. One end of an operation cable C, which couples the cable engaging portion 122 with an operation handle provided on the back door D, is engaged with the end of the cable engaging portion 122 as illustrated in FIG. 3.

Figure 17:
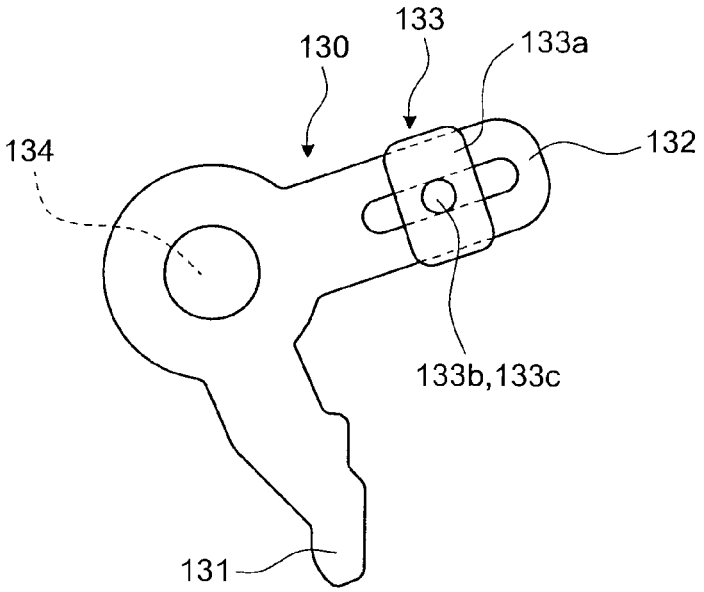
FIG. 17 is a front view of an open lever applied to the actuator unit of the vehicular latch device illustrated in FIG. 1.

The open lever 130 is arranged on a position overlapped with the cable lever 120 as illustrated in FIGS. 14 and 15, and has a release operation output portion 131, an engaging input portion 132, and a shaft hole 134 through which the open lever shaft 101 is inserted as illustrated in FIG. 17.

The release operation output portion 131 is radially outwardly provided about the shaft hole 134 and an end thereof is inserted from the opening for lever insertion 54 into the latch cover portion 50A. The end of the release operation output portion 131 located on a right side of the first release operating portion 32 as indicated by a dashed-two dotted line in FIG. 5 pushes the first release operating portion 32 of the ratchet 30 leftward in the drawing to switch the latch 20 to the unlatched position illustrated in FIG. 5A when the open lever 130 rotates in the clockwise direction in FIG. 15 about an axis of the open lever shaft 101.

The engaging input portion 132 is radially outwardly provided on a position shifted from the release operation output portion 131 by approximately 90 degrees about the shaft hole 134 as illustrated in FIG. 17. A slider 133 is provided on the engaging input portion 132. The slider 133 has a slide base portion 133*a* arranged so as to be movable in an extending direction of the engaging input portion 132, an engaging pin 133*b* provided so as to be projected on a surface facing to the unit holding portion 50B of the slide base portion 133*a*, and a cam pin 133*c* provided so as to be projected on a surface spaced apart from the unit holding portion 50B on the slide base portion 133*a*. If the slider 133 is arranged on a shaft hole 134 side of the engaging input portion 132, when this is rotated in the counterclockwise direction in FIGS. 14 and 15 about the axis of the open lever shaft 101, the engaging pin 133*b* engages with the operation output portion 121 of the cable lever 120, and on the other hand, when this moves to a tip end side of the engaging input portion 132, the engaging pin 133*b* does not engage with the operation output portion 121 of the cable lever 120. Meanwhile, an open lever spring 135 for always rotating the open lever 130 in the counterclockwise direction is interposed between the open lever 130 and the unit holding portion 50B as illustrated in FIGS. 14 and 15.

Figure 18:
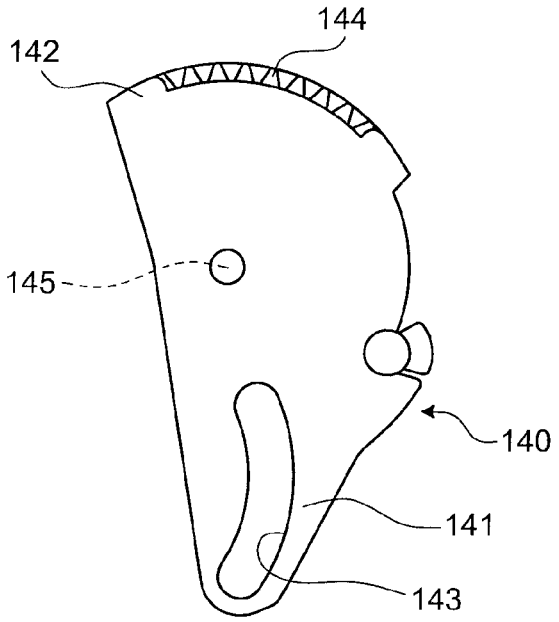
FIG. 18 is a front view of a lock lever applied to the actuator unit of the vehicular latch device illustrated in FIG. 1.

The lock lever 140 is rotatably supported on the lock lever shaft 102 provided on a side closer to the center of the unit holding portion 50B than the open lever shaft 101 and a position spaced apart from a bent portion bent from the latch cover portion 50A as illustrated in FIGS. 14 and 15. The lock lever 140 has a cam lever portion 141, a sector gear portion 142, and a shaft hole 145 through which the lock lever shaft 102 is inserted as illustrated in FIG. 18 and is supported on the lock lever shaft 102 in a manner in which the cam lever portion 141 is overlapped with the engaging input portion 132 of the open lever 130. The cam lever portion 141 is radially outwardly provided about the shaft hole 145 and has a cam groove 143 formed of an elongated hole formed thereon. The cam groove 143 is formed so as to be bent along a circular arc about the open lever shaft 101 when it is attached to the unit holding portion 50B as the actuator unit 100 and the cam pin 133*c* of the slider 133 is engaged therewith so as to be slidable. The sector gear portion 142 is formed into a sector shape on a position opposed to the cam lever portion 141 across the shaft hole 145 and has the gear 144 formed on a circular arc-shaped outer peripheral surface thereof.

The electric motor 110 is arranged on a position farthest from the open lever shaft 101 of the unit holding portion 50B and a worm gear 112 is provided on an output shaft 111 thereof as illustrated in FIGS. 2, 14, and 15. The worm gear 112 meshes with the gear 144 formed on the sector gear portion 142 of the lock lever 140. When the electric motor 110 is driven, it is possible to rotate the lock lever 140 about an axis of the lock lever shaft 102.

A unit cover 150 is provided on the above-described actuator unit 100 as illustrated in FIGS. 1 to 3. The unit cover 150 formed of a synthetic resin material to have a size to cover an entire actuator unit 100 except the cable engaging portion 122 of the cable lever 120 is attached to the unit holding portion 50B by fastening means such as a screw. The unit cover 150 has a pair of terminal members 151 and 152 provided on a motor accommodating unit for accommodating the electric motor 110 as illustrated in FIGS. 1 and 2. The terminal members 151 and 152 serves as power feeding terminals of the electric motor 110, and one ends of the terminal members 151 and 152 project toward a terminal mounting hole 153 opening on an outer surface of the unit cover 150 to compose connector connecting terminals.

The coupler 160 is arranged above the unit holding portion 503 illustrated in FIG. 2. The signal cables 210*a* and 210*b* extend from the coupler 160 along the unit holding portion 50B of the back plate 50 toward a base end of the latch cover portion 50A. The signal cables 210*a* and 210*b* extending from the coupler 160 are coated with a cable tube 211 to be brought together into one and are inserted into the main body 40 mounted on the cover plate 10 from a lower end of the unit holding portion 50B. Ends of the signal cables 210*a* and 210*b* getting out of the coating of the cable tube 211 are thereafter connected to the plus terminal 202*a* and the minus terminal 202*b* of the latch detecting sensor 200, respectively.

The signal cables 210*a* and 210*b* are inserted into the main body 40 through a gap formed between the back plate 50 and the cover plate 10 as illustrated in FIG. 2. The signal cables 210*a* and 210*b* are arranged on a surface inner portion of the bottom surface portion 410 from the cable insertion groove 419 illustrated in FIGS. 8 and 10 to 12. Thereafter, the signal cables 210*a* and 210*b* are separated by the abutment rib 418 to be connected to the plus terminal 202*a* and the minus terminal 202*b* of the latch detecting sensor 200, respectively.

Figure 14B:
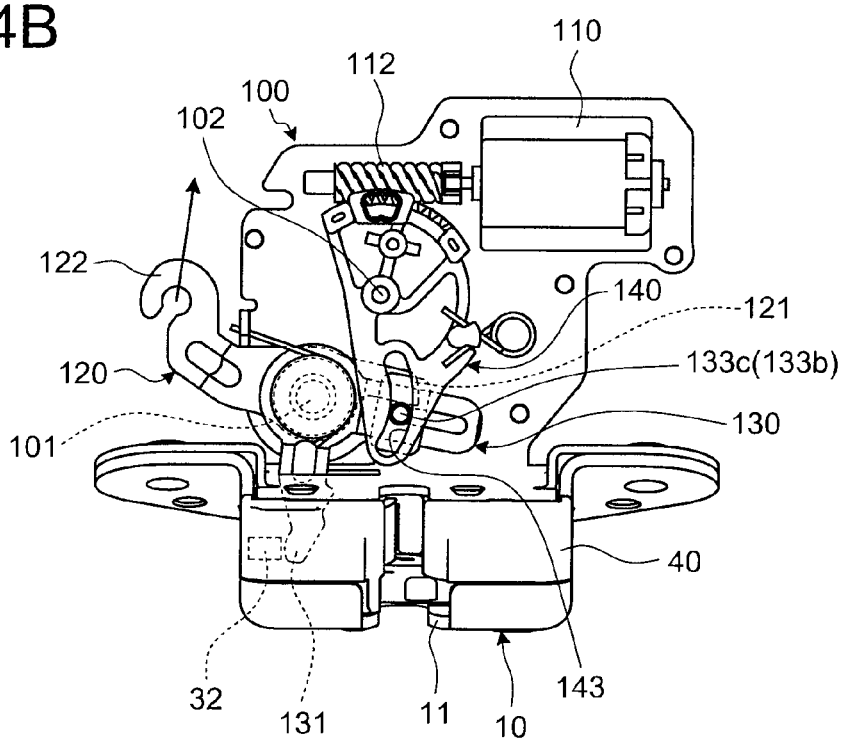

Hereinafter, operation of the above-described vehicular latch device LA is described. In the unlocked state in which lock of the back door D is released, the actuator unit 100 is arranged on a position illustrated in FIG. 14A. At that time, the slider 133 of the open lever 130 moves on the shaft hole 134 side of the engaging input portion 132 through the cam pin 133*c* engaging with the cam groove 143. In the vehicular latch device LA in the unlocked state, when opening operation is performed to the operation handle provided on the back door D to pull the cable engaging portion 122 in a direction indicated by an arrow in the drawing through the operation cable C, the cable lever 120 rotates in the clockwise direction as illustrated in FIG. 14B. In the unlocked state, the slider 133 is located on the shaft hole 134 side of the engaging input portion 132 in the open lever 130. Therefore, the operation output portion 121 of the cable lever 120 engages with the engaging pin 133*b* of the slider 133. Therefore, when the opening operation is performed to the operation handle, as illustrated in FIG. 14B, the open lever 130 rotates in the clockwise direction through the slider 133 and the release operation output portion 131 pushes the first release operating portion 32 of the ratchet 30 to rotate the ratchet 30 in the counterclockwise direction in FIG. 5. Therefore, meshing of the ratchet 30 with the latch 20 is released, the latch 20 rotates from the fully-latched position in FIG. 5C through the half-latched position in FIG. 5B to the unlatched position in FIG. 5A, and engagement thereof with the striker S is released. As a result, the vehicular latch device LA may open the back door D by the opening operation of the operation handle in the unlocked state. On the half-latched position in FIG. 5B and the unlatched position in FIG. 5A, the plunger 203 of the latch detecting sensor 200 abuts the convex stripe 25 of the latch 20 and the latch detecting sensor 200 is put into an ON state. By turning on an interior lamp, for example, in association with the ON state, it is possible to inform crew of a half-opened state or an opened state of the back door D.

By driving the electric motor 110 in the state in which the back door D is closed and rotating the lock lever 140 in the counterclockwise direction from the unlocked state illustrated in FIG. 14, the lock lever 140 is arranged on a position illustrated in FIG. 15A and the slider 133 of the open lever 130 moves to the tip end side of the engaging input portion 132 through the cam pin 133*c* engaging with the cam groove 143. At that time, by performing the opening operation to the operation handle provided on the back door D to pull the cable engaging portion 122 in a direction indicated by an arrow in the drawing as illustrated in FIG. 15B through the operation cable C, the cable lever 120 rotates in the clockwise direction. However, since the slider 133 is located on the tip end side of the engaging input portion 132 in the open lever 130, the operation output portion 121 of the cable lever 120 does not engage with the engaging pin 133*b* of the slider 133. Therefore, even when the opening operation is performed to the operation handle, the open lever 130 does not rotate, and the release operation output portion 131 of the open lever 130 does not push the first release operating portion 32 of the ratchet 30, so that the engagement of the ratchet 30 with the latch 20 is not released. Therefore, even when the opening operation is performed to the operation handle, the vehicular latch device LA cannot open the back door D, so that it is in the locked state. In the state in which the back door D is closed, the latch 20 is in the fully-latched position in FIG. 5C and the latch detecting sensor 200 is put into an OFF state without abutting the convex stripe 25 of the latch 20. At that time, by turning off the interior lamp, for example, it is possible to inform the crew of the closed state of the back door D.

When water such as rainwater adheres to the back door D when it rains and the like, the adhering water might enter inside of the back door D and thereafter enter the vehicular latch device LA from a gap Z between the plate wall portion 10*b* of the cover plate 10 and the back plate 50 illustrated in FIG. 1 directly or through the signal cables 210*a* and 210*b*. Although it is possible to discharge the entering water outside the vehicle through the latch 20 and the ratchet 30, if the plus terminal 202*a* and the minus terminal 202*b* of the detecting sensor 200 are unexpectedly conducted by the entering water, there may be a case in which a false signal is transmitted and a rotational state of the latch 20 cannot be correctly detected. Therefore, it is required to appropriately discharge the water, which enters the vehicular latch device LA.

In the state in which the back door D is closed, the water, which directly enters from the gap Z, is prevented from entering between the main body 40 and the latch cover portion 50A by the first wall portion 421 illustrated in FIG. 1. The water, which adheres to the first wall portion 421, drops in the cover plate 10 to be discharged outside the vehicle through the latch 20 or the ratchet 30.

The water, which enters between the main body 40 and the latch cover portion 50A over the first wall portion 421 or through the signal cables 210*a* and 210*b*, is separated to right and left by means of the abutment rib 418 (upstream side) illustrated in FIGS. 10 to 12. The separated water is discharged from the discharging hole 417 formed on the bottom surface portion 410 to the cover plate 10 located on a lower side of the vehicle (downstream side) before reaching the latch detecting sensor 200. The water discharged to the cover plate 10 is discharged outside the vehicle through the latch 20 and the ratchet 30. The water, which enters a latch shaft 12 side over the latch detecting sensor 200, is discharged from the notch for convex stripe 413 of the main body 40 to a side of the latch 20 located on the lower side of the vehicle (downstream side) to be discharged outside the vehicle.

Meanwhile, in the state in which the back door D is opened, the latch cover portion 50A is located on the lower side of the vehicle (downstream side) than the cover plate 10. Therefore, the water, which enters between the latch cover portion 50A and the main body 40, drops on a surface on a side of the main body 40 of the latch cover portion 50A and accumulated water flows outside the vehicular latch device LA from a gap between the latch cover portion 50A and the projected surface portions 44*a* and 44*b* to be discharged.

In the vehicular latch device LA configured in this manner, the water is discharged outside the main body 40 from the discharging hole 417 located on the downstream side before reaching the sensor body 201 through the plus terminal 202*a* and the minus terminal 202*b* of the latch detecting sensor 200 located on the upstream side, so that the water is not accumulated between the plus terminal 202*a* and the minus terminal 202*b* and it is possible to prevent the water from adhering to the sensor body 201. Also, even when the water reaches the plus terminal 202*a* and the minus terminal 202*b*, the water is separated by the abutment rib 418 to a side of the plus terminal 202*a* and aside of the minus terminal 202*b*, so that it is possible to prevent the plus terminal 202*a* and the minus terminal 202*b* from being unexpectedly conducted. As a result, it is possible to maintain detection accuracy of the latch detecting sensor 200 at a low cost without applying waterproof treatment such as a sensor case to the latch detecting sensor 200. Also, since it is possible to arrange the latch detecting sensor 200 in the vicinity of the latch 20 being a body to be detected without providing the sensor case, it is possible to miniaturize the vehicular latch device LA.

Also, it is possible to easily attach the latch detecting sensor 200 to a predetermined position by allowing the same to abut the abutment rib 418 and to be interposed between the sensor locking portions 415 and 416, thereby improving workability. Further, since the convex stripe 25 is arranged on a surface side of the main body 40 illustrated in FIG. 8 through the notch for convex stripe 413 formed on the main body 40 and the latch 20 and the ratchet 30 are arranged on a rear surface side of the main body 40 through the bottom surface portion 410, even when grease is sufficiently applied to the latch 20 and the ratchet 30, there is no possibility that this adheres to the latch detecting sensor 200 to cause detection trouble.

Meanwhile, the plus terminal 202*a* and the minus terminal 202*b* of the latch detecting sensor 200 may be arranged in an opposite manner. Also, a ratchet detecting sensor (not illustrated) for detecting rotation of the ratchet may be used in place of the latch detecting sensor 200. When the ratchet detecting sensor is used, it may be configured that the above-described discharging hole 417 and abutment rib 418 are provided corresponding to the ratchet detecting sensor, respectively. Although the vehicular latch device to be mounted on the back door D is described in this embodiment, the door on which this is mounted is not limited to the back door, it is only necessary that the water is discharged from the discharging portion of the main body provided on the lower side of the vehicle (downstream side) than the terminal of the latch detecting sensor or the ratchet detecting sensor provided on the upper side of the vehicle (upstream side) in the state in which the door is closed, and it is also possible that the terminal of the latch detecting sensor or the ratchet detecting sensor is arranged so as to be inclined with respect to the discharging portion (substantially same positions in vertical direction of vehicle). Also, a side door and the like of which arrangement relationship is not changed by opening and closing of the door may be used if the terminal of the detecting sensor (upstream side) is arranged on the upstream side of the discharging portion (downstream side) with respect to a flow of the water.

Second Embodiment

Figure 19:
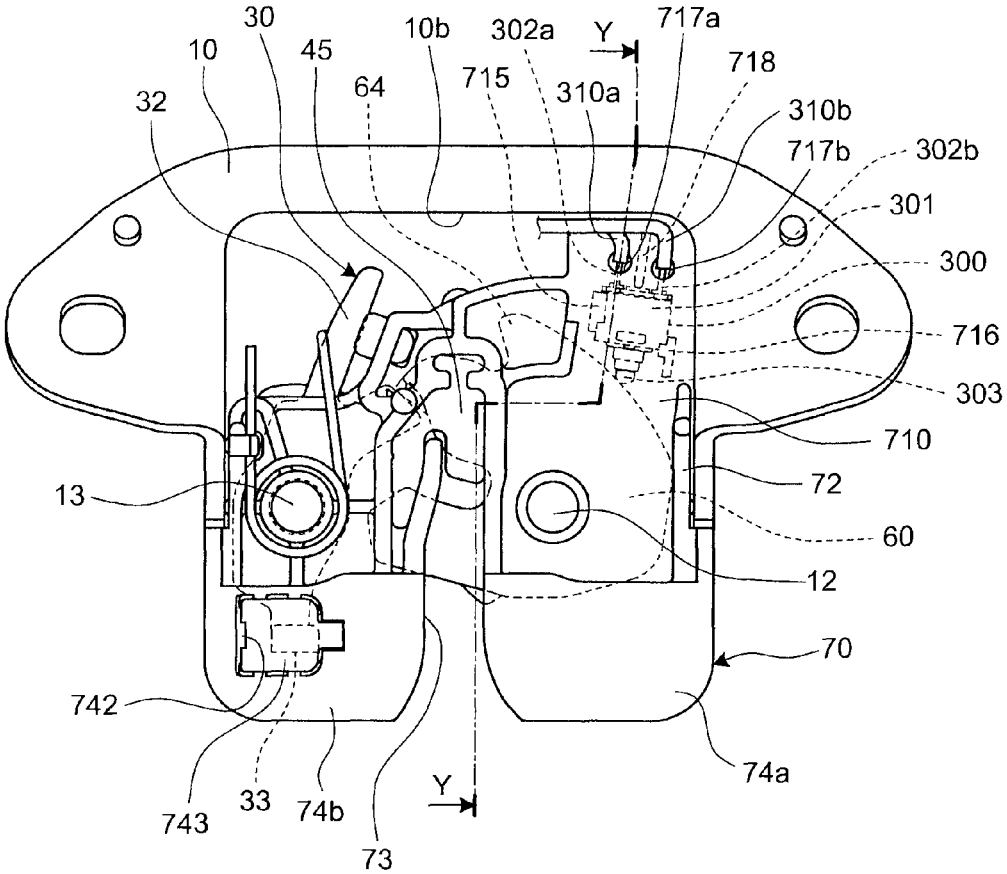
FIG. 19 is a plan view illustrating a state in which the main body and the latch detecting sensor are attached to the cover plate of the vehicular latch device of another embodiment of the present invention.
Figure 20:
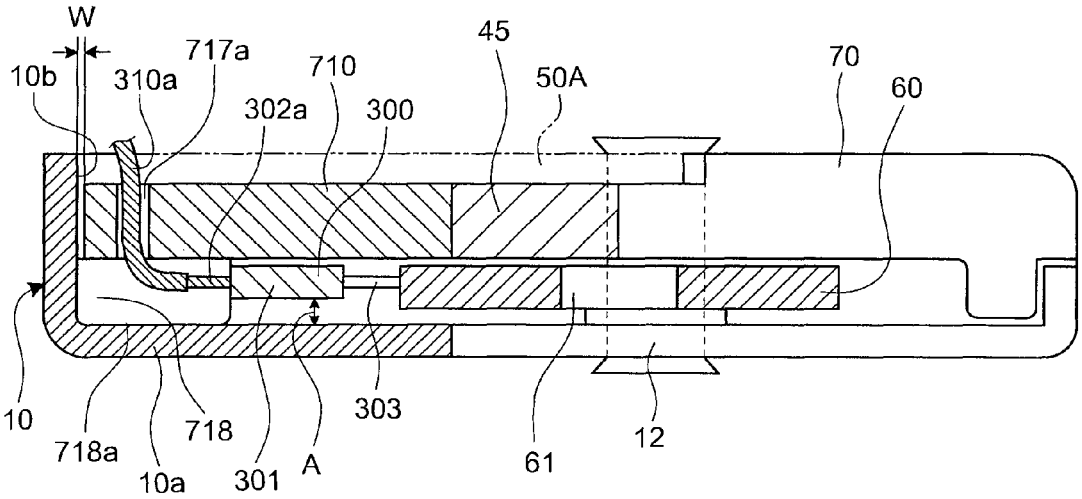
FIG. 20 is a cross-sectional view taken in a direction of an arrow Y in FIG. 19.

Next, another embodiment of the vehicular latch device according to the present invention is described. The vehicular latch device of a second embodiment has a latch 60, a main body 70, a latch detecting sensor 300, and signal cables 310*a* and 310*b* in place of the latch 20, the main body 40, the latch detecting sensor 200, and the signal cables 210*a* and 210*b* of the first embodiment as illustrated in FIGS. 19 and 20. In the second embodiment, the same reference numeral as that in the first embodiment indicates the same configuration and this is not herein described in detail.

Figure 21:
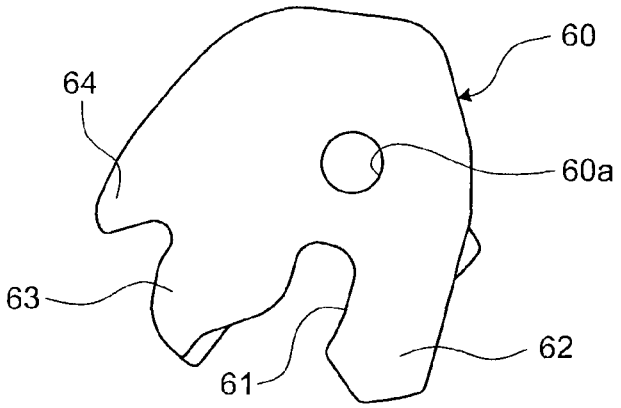
FIG. 21 is a plan view of the latch of another embodiment of the present invention.

The latch 60 is a plate-shaped member on which an insertion hole 60*a* through which the latch shaft 12 is inserted is formed and has an engaging groove 61 opening on an outer peripheral surface thereof, a hook portion 62 located on a right side of the engaging groove 61, a striker abutment portion 63 located on a left side of the engaging groove 61, and an outer peripheral detent portion 64 located on a left side of the striker abutment portion 63 as illustrated in FIG. 21. The latch 60 rotates about the axis of the latch shaft 12 such that the engaging groove 61 intersects with the striker entry groove 11. The latch 60 is biased in the counterclockwise direction in FIG. 19 about the latch shaft 12 by a latch spring (not illustrated).

The main body 70 is obtained by forming a relatively hard synthetic resin material into a thick block shape and this covers the inner surface of the front end of the cover plate 10 on which the latch 60 and the ratchet 30 are arranged as illustrated in FIG. 19. The main body 70 has a bottom surface portion 710, which is a plate-shaped flat surface, a wall portion 72 perpendicularly provided in a standing manner from the bottom surface portion 710, a buffer groove 73 formed on a position corresponding to the striker entry groove 11, and projected surface portions 74*a* and 74*b* formed on both sides of the buffer groove 73 to cover the inner surface of the front end of the plate base portion 10*a*.

Figure 22:
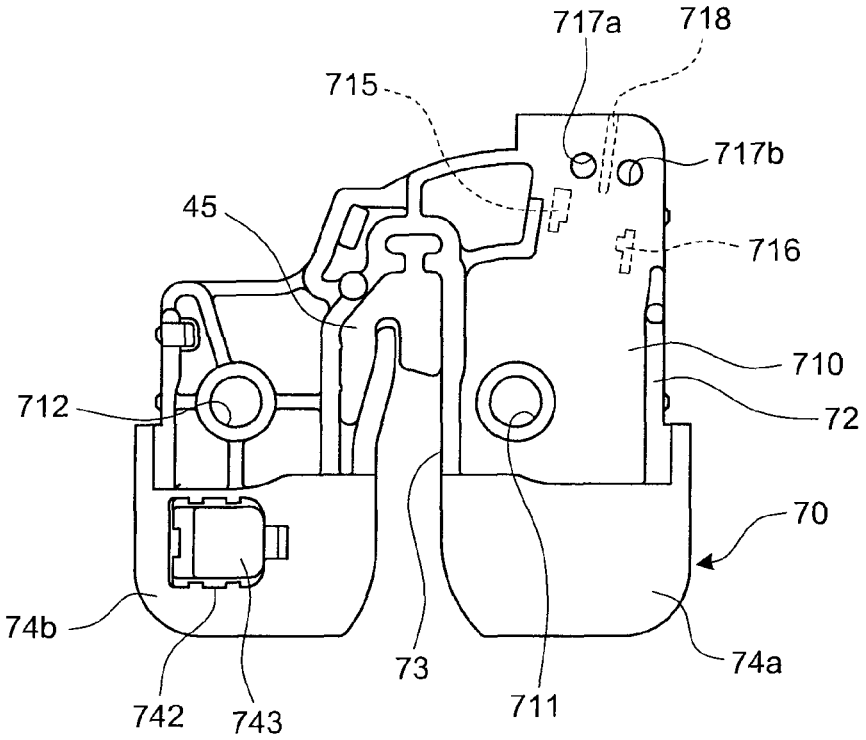
FIG. 22 is a plan view of the main body of another embodiment of the present invention seen from a front side.

The bottom surface portion 710 has a latch shaft insertion hole 711, a ratchet shaft insertion hole 712, sensor locking portions 715 and 716, cable holes 717*a* and 717*b*, and a abutment rib 718 as illustrated in FIG. 22.

The latch shaft insertion hole 711 and the ratchet shaft insertion hole 712 are formed on positions corresponding to the latch shaft 12 and the ratchet shaft 13, correspondingly. The latch shaft insertion hole 711 and the ratchet shaft insertion hole 712 are through-holes with inner diameters fit to the latch shaft 12 and the ratchet shaft 13, respectively, and lengths thereof in the axial direction are set to be shorter than those of the latch shaft 12 and the ratchet shaft 13, respectively.

The sensor locking portions 715 and 716 are plate-shaped members perpendicularly provided in a standing manner from the bottom surface portion 710 toward a rear surface of FIG. 22. Locking detents (not illustrated) are provided on inner surfaces of tip ends of the sensor locking portions 715 and 716 opposed to each other.

The cable holes 717*a* and 717*b* are through-holes obtained by cutting the bottom surface portion 710 as illustrated in FIGS. 19, 20, and 22. The cable holes 717*a* and 717*b* are formed by cutting the bottom surface portion 710 in a substantially circular shape with a size such that the signal cables 310*a* and 310*b* may be inserted therethrough, respectively.

The abutment rib 718 is a plate-shaped member perpendicularly provided in a standing manner from the bottom surface portion 710 toward the rear surface of FIG. 22 as illustrated in FIGS. 19, 20, and 22. The abutment rib 718 is formed so as to be located between the cable holes 717*a* and 717*b*. As illustrated in FIG. 20, an end 718*a* of the abutment rib 718, which is the end farthest from the bottom surface portion 710, is arranged so as to abut inner surfaces of the plate base portion 10*a* and the plate wall portion 10*b* of the cover plate 10.

The buffer groove 73 is a notch provided from a front end central portion toward a base end of the main body 70 as illustrated in FIGS. 19 and 22, and is formed so as to be slightly narrower in width than the striker entry groove 11.

The buffer groove 73 is formed so as to be gradually narrower toward an inner portion thereof while an opening end thereof has a size such that the striker S may be inserted therethrough. Also, the elastic member 45 as the cushion is mounted on an innermost portion of the buffer groove 73.

The projected surface portions 74*a* and 74*b* are surfaces provided on both sides of the buffer groove 73 as illustrated in FIGS. 19 and 22 formed so as to be raised above the bottom surface portion 710. A through-hole 742 for operating the second release operating portion 33 of the ratchet 30 covered with the main body 70 from outside and a lid portion 743 for blocking the through-hole 742 so as to be openable are formed on the projected surface portion 74*b* on a ratchet side.

A latch detecting sensor 300 is arranged on the main body 70. The latch detecting sensor 300, which is referred to as the micro switch, has a sensor body 301 formed into a substantially cuboid shape, a plus terminal 302*a* and a minus terminal 302*b* exposed from the sensor body 301, and a plunger 303. The sensor body 301 is interposed to be held between the sensor locking portions 715 and 716 formed on a rear surface of the main body 70 illustrated in FIG. 22. As illustrated in FIG. 20, the sensor body 301 is formed so as to be thinner than the latch 60 and is arranged so as to form a gap A (discharging portion) in a state where the sensor body 301 is spaced apart from the plate base portion 10*a* of the cover plate 10. As illustrated in FIG. 19, the plus terminal 302*a* and the minus terminal 302*b* are arranged so as to be located closer to the plate wall portion 10*b* than the sensor main body 301. A side surface on a side of the plus terminal 302*a* and the minus terminal 302*b* of the latch detecting sensor 300 abuts the abutment rib 718 to be fixed to the main body 70. The plunger 303 is arranged so as to be located on a side of the latch 60. The outer peripheral detent portion 64 of the latch 60 rotates to abut the plunger 303, and according to this, the plunger 303 detects a rotational position of the latch 60. Signal cables 310*a* and 310*b* for transmitting the detection signal are connected to the plus terminal 302*a* and the minus terminal 302*b* of the latch detecting sensor 300, respectively. The signal cables 310*a* and 310*b* extend from the coupler 160 and are inserted into the cable holes 717*a* and 717*b* from a surface of the main body 70 illustrated in FIG. 19 to be connected to the plus terminal 302*a* and the minus terminal 302*b* of the latch detecting sensor 300 arranged on the rear surface of the main body 70.

Next, a discharge path of the water, which enters the vehicular latch device of the second embodiment, is described. The water such as the rainwater, which adheres to the back door D when it rains and the like, might enter inside of the back door D and thereafter enter the vehicular latch device from the gap between the plate wall portion 10*b* of the cover plate 10 and the back plate 50 directly or through the signal cables 310*a* and 310*b*.

In the state in which the back door D is closed, the water, which directly enters from the gap between the plate wall portion 10*b* and the back plate 50, might enter the cover plate 10 from a gap W between the main body 70 and the cover plate 10 illustrated in FIG. 20. The entering water passes through the plus terminal 302*a* (upstream side) and the minus terminal 302*b* (upstream side) in a state of being separated to a side of the signal cable 310*a* and a side of the signal cable 310*b* by the abutment rib 718 (upstream side) and thereafter reaches the inner surface of the plate base portion 10*a* to be discharged to the side of the latch 60 through the gap A (downstream side) and is discharged outside the vehicle.

The water, which enters between the main body 70 and the cover plate 10 from the cable holes 717*a* and 717*b* through the signal cables 310*a* and 310*b*, is separated to the side of the signal cable 310*a* and the side of the signal cable 310*b* by the abutment rib 718. The separated water reaches the sensor body 301 or the inner surface of the plate base portion 10*a* through the plus terminal 302*a* (upstream side) and the minus terminal 302*b* (upstream side) and is thereafter discharged to the side of the latch 60 through the gap A (downstream side) to be discharged outside the vehicle, respectively.

In the state in which the back door D is opened, the latch cover portion 50A is located on the lower side of the vehicle (downstream side) than the cover plate 10. At that time, the water, which enters between the cover plate 10 and the main body 70, flows to the side of the latch 60 through a lower surface of the bottom surface portion 710 illustrated in FIG. 20 in a state of being separated by the abutment rib 718 to be discharged outside the vehicle.

In the vehicular latch device thus configured, when the water reaches the plus terminal 302*a*, the minus terminal 302*b*, and the sensor body 301 of the latch detecting sensor 300, the water is separated to the plus terminal 302*a* side and the minus terminal 302*b* side by the abutment rib 718, so that it is possible to prevent the plus terminal 302*a* and the minus terminal 302*b* from being unexpectedly conducted. Also, by forming the gap A (discharging portion) on the lower side of the vehicle (downstream side) than the plus terminal 302*a* and the minus terminal 302*b*, it is possible to discharge the water outside the vehicular latch device without accumulating the water between the plus terminal 302*a* and the minus terminal 302*b*. As a result, it is possible to maintain the detection accuracy of the latch detecting sensor 300 at a low cost without applying the waterproof treatment such as the sensor case to the latch detecting sensor 300.

Also, it is possible to easily attach the latch detecting sensor 300 to a predetermined position by allowing the same to abut the abutment rib 718 and to be interposed to be held between the sensor locking portions 715 and 716, so that the workability thereof may be improved. Further, it is possible to arrange the latch detecting sensor 300 and the latch 60 on the same surface of the main body 70 without providing the sensor case on the latch detecting sensor 300, it is possible to miniaturize the vehicular latch device by reducing a thickness thereof.

Meanwhile, the plus terminal 302*a* and the minus terminal 302*b* of the latch detecting sensor 300 may be arranged in an opposite manner. Also, the ratchet detecting sensor (not illustrated) for detecting the rotation of the ratchet may be used in place of the latch detecting sensor 300. When the ratchet detecting sensor is used, it may be configured that the above-described gap A (discharging portion) and abutment rib 718 are provided corresponding to the ratchet detecting sensor. Although the vehicular latch device to be mounted on the back door D is described in this embodiment, the door on which this is mounted is not limited to the back door, it is only necessary that the water is discharged from the discharging portion of the main body provided on the lower side of the vehicle (downstream side) than the terminal of the latch detecting sensor or the ratchet detecting sensor provided on the upper side of the vehicle (upstream side), and it is also possible that the terminal of the latch detecting sensor or the ratchet detecting sensor is arranged so as to be inclined with respect to the discharging portion (substantially same position in vertical direction of vehicle). Also, the side door and the like of which arrangement relationship is not changed by the opening and closing of the door may be used if the terminal of the detecting sensor (upstream side) is arranged on the upstream side of the discharging portion (downstream side) with respect to the flow of the water.

REFERENCE SIGNS LIST

10 cover plate
11 striker entry groove
20, 60 latch
30 ratchet
40, 70 main body
410, 710 bottom surface portion
415, 416, 715, 716 sensor locking portion
417 discharging hole (discharging portion)
418, 718 abutment rib
421 first wall portion
200, 300 latch detecting sensor
201, 301 sensor body
202*a*, 302*a* plus terminal
202*b*, 302*b* minus terminal
210*a*, 210*b*, 310*a*, 310*b* signal cable
A gap (discharging portion)
B vehicle body
D back door
LA latch device for vehicle
S striker

The invention claimed is:

1. A latch device for a vehicle provided on a door of the vehicle, comprising:
a latch configured to mesh with a striker;
a ratchet which regulates rotation of the latch;
a detecting sensor including a body, at least two terminals exposed from the body, with signal cables being connected to the terminals, the detecting sensor being configured to detect operation of the latch or the ratchet;
a main body in which the detecting sensor is arranged, the main body including
a discharging hole at a position in an area between the terminals of the detecting sensor, at least one of the two terminals of the detecting sensor being arranged on an upper side of the vehicle above the discharging hole in a state in which the door is closed, and
a rib separating and parallel to the two terminals, wherein the rib projects from the discharging hole,
wherein the discharging hole is formed so as to extend from the body of the detecting sensor toward a side of the terminals,
wherein the detecting sensor is arranged so as to abut the rib, and
wherein the discharging hole is configured to discharge at least one of water entering through the signal cables and water separated by the rib.

2. The latch device for a vehicle according to claim 1, wherein the rib is substantially between the terminals.

3. The latch device for a vehicle according to claim 1,
wherein the main body includes a surface on which the detecting sensor is arranged, and
wherein the latch and the ratchet are arranged on a side opposite to the detecting sensor on another surface of the main body.

4. The latch device for a vehicle according to claim 1,
wherein the door is a tailgate of the vehicle, and
wherein the latch is configured to mesh with the striker so as to maintain a closed state of the tailgate.

5. The latch device for a vehicle according to claim 1, wherein the latch comprises:
a meshing groove configured to mesh with a groove of the striker,
a hook portion disposed laterally to the meshing groove so as to be on a first side from the meshing groove, and
an abutment portion disposed laterally to the meshing groove so as to be on a second side of the meshing groove.

6. A latch device for a vehicle provided on a door of the vehicle, comprising:
a latch configured to mesh with a striker;
a ratchet which regulates rotation of the latch;
a detecting sensor including a body, at least two terminals exposed from the body, with signal cables being connected to the terminals, the detecting sensor being configured to detect operation of the latch or the ratchet; and
a main body in which the detecting sensor is arranged, and including a rib separating the two terminals and projecting from a discharging hole configured to discharge water,
wherein the discharging hole is disposed at a position in an area between the terminals of the detecting sensor, and formed so as to extend from the body of the detecting sensor toward a side of the terminals,
wherein at least one of the two terminals of the detecting sensor is arranged on an upstream side of the discharging hole with respect to a flow of the water,
wherein the detecting sensor is arranged so as to abut the rib,
wherein the discharging hole is configured to discharge at least one of water entering through the signal cables and water separated by the rib, and
wherein ends of the terminals are parallel to and spaced apart by the rib.

7. The latch device for a vehicle according to claim 6,
wherein the door is a tailgate of the vehicle, and
wherein the latch is configured to mesh with the striker so as to maintain a closed state of the tailgate.

8. The latch device for a vehicle according to claim 6, wherein the latch comprises:
a meshing groove configured to mesh with a groove of the striker,
a hook portion disposed laterally to the meshing groove so as to be on a first side from the meshing groove, and
an abutment portion disposed laterally to the meshing groove so as to be on a second side of the meshing groove.

9. A latch device for a vehicle provided on a door of the vehicle, comprising:
a latch configured to mesh with a striker;
a ratchet which regulates rotation of the latch;
a detecting sensor including a body, at least two terminals exposed from the body, with signal cables being connected to the terminals, the detecting sensor being configured to detect operation of the latch or the ratchet;
a main body in which the detecting sensor is arranged, the main body including
a discharging hole at a position in an area between the terminals of the detecting sensor, at least one of the two terminals of the detecting sensor being arranged on an upper side of the vehicle above the discharging hole in a state in which the door is closed, and
a rib separating and parallel to the two terminals, wherein the rib projects from the discharging hole,
wherein the discharging hole is formed so as to extend from the body of the detecting sensor toward a side of the terminals,
wherein the detecting sensor is arranged so as to abut the rib, and wherein the discharging hole is configured to discharge at least one of water entering through the signal cables and water separated by the rib, such that the water is not accumulated between the terminals.

* * * * *